US009289024B2

(12) United States Patent
Withnall et al.

(10) Patent No.: US 9,289,024 B2
(45) Date of Patent: Mar. 22, 2016

(54) PROTECTIVE SPORTS HELMET

(75) Inventors: Chris Withnall, Nepean (CA); Michael Wonnacott, Ottawa (CA); Vittorio Bologna, Medinah, IL (US); Thad M. Ide, Chicago, IL (US); Ralph Infusino, Bloomingdale, IL (US); Nelson Kraemer, Mount Prospect, IL (US)

(73) Assignee: Riddell, Inc., Rosemont, IL (US)

( * ) Notice: Subject to any disclaimer, the term of this patent is extended or adjusted under 35 U.S.C. 154(b) by 1018 days.

(21) Appl. No.: 13/068,104

(22) Filed: May 2, 2011

(65) Prior Publication Data

US 2011/0271428 A1 Nov. 10, 2011

Related U.S. Application Data

(63) Continuation-in-part of application No. 12/082,920, filed on Apr. 15, 2008, now Pat. No. 8,813,269.

(60) Provisional application No. 60/923,603, filed on Apr. 16, 2007, provisional application No. 61/343,567, filed on Apr. 30, 2010.

(51) Int. Cl.
*A42B 3/00* (2006.01)
*A42B 1/06* (2006.01)
(Continued)

(52) U.S. Cl.
CPC ..... *A42B 3/20* (2013.01); *A63B 71/081* (2013.01); *A63B 71/10* (2013.01); *A63B 2209/10* (2013.01);
(Continued)

(58) Field of Classification Search
CPC ..... A42B 3/20; A42B 3/064; A42B 3/14; A42B 3/18; A42B 3/22; A63B 71/081; A63B 7/10; A63B 2209/10; A63B 2243/005; A63B 2243/0045; A63B 2243/007; A63B 2243/0041
USPC ..... 2/410, 411, 414, 422, 424, 425, 9, 429, 2/427
See application file for complete search history.

(56) References Cited

U.S. PATENT DOCUMENTS 1,060,220 A 4/1913 White
1,203,564 A 11/1916 April
(Continued)

FOREIGN PATENT DOCUMENTS

CH 692011 1/2002
DE 8321097 10/1983
(Continued)

OTHER PUBLICATIONS

Declaration of Michael W. Irvin dated Aug. 30, 2012.
(Continued)

*Primary Examiner* — Khoa Huynh
*Assistant Examiner* — Katharine Gracz
(74) *Attorney, Agent, or Firm* — McDermott Will & Emery LLP

(57) ABSTRACT

A protective sports helmet that includes an energy attenuating faceguard mounting system, which includes at least one dynamic connector that secures the faceguard to the helmet shell without a connection point in the shell's brow region. The lack of a brow region connection point results in a gap or clearance between the faceguard and the shell that has a functional interplay with the dynamic connector upon an impact to the faceguard. In general terms, when a substantially on-center impact to the faceguard occurs, the faceguard is displaced towards the shell and the connector bracket flexes outward relative to the helmet shell to help dissipate impact energy.

20 Claims, 13 Drawing Sheets

(51) Int. Cl.

| | |
|---|---|
| ***A63B 71/10*** | (2006.01) |
| ***A42B 3/20*** | (2006.01) |
| ***A63B 71/08*** | (2006.01) |

(52) U.S. Cl.

CPC ..... *A63B 2243/005* (2013.01); *A63B 2243/007* (2013.01); *A63B 2243/0041* (2013.01); *A63B 2243/0045* (2013.01)

(56) References Cited

U.S. PATENT DOCUMENTS

| | | | | |
|---|---|---|---|---|
| 1,262,818 | A | | 4/1918 | McGill |
| 1,449,183 | A | | 3/1923 | Johnstone |
| 1,522,952 | A | | 1/1925 | Goldsmith |
| 1,655,007 | A | | 1/1928 | Boettge |
| 1,691,202 | A | | 11/1928 | Van |
| 1,705,879 | A | | 3/1929 | Rodgers |
| 1,868,926 | A | | 7/1932 | Tatore |
| 1,892,943 | A | | 1/1933 | Geyer |
| 2,140,716 | A | | 12/1938 | Pryale |
| 2,250,275 | A | | 7/1941 | Riddell |
| 2,296,335 | A | | 9/1942 | Brady |
| 2,354,840 | A | | 8/1944 | Seletz |
| 2,373,083 | A | | 4/1945 | Brewster et al. |
| 2,515,807 | A | | 7/1950 | Spooner |
| 2,570,182 | A | | 10/1951 | Daly et al. |
| 2,688,747 | A | | 9/1954 | Marx |
| 2,758,304 | A | | 8/1956 | McGowan |
| 2,768,380 | A | | 10/1956 | Golomb |
| 2,779,228 | A | | 1/1957 | Meepos et al. |
| 2,785,405 | A | | 3/1957 | Snyder |
| D180,239 | S | | 5/1957 | McMurry |
| 2,850,740 | A | | 9/1958 | Adams |
| 2,861,272 | A | | 11/1958 | Stuart |
| 2,867,811 | A | | 1/1959 | Jones |
| 2,904,645 | A | | 9/1959 | Sarles |
| 2,969,546 | A | | 1/1961 | Morgan, Jr. |
| 2,985,883 | A | | 5/1961 | Marietta |
| 2,986,739 | A | | 6/1961 | Rozzi |
| 3,039,108 | A | | 6/1962 | Lohrenz |
| 3,113,318 | A | | 12/1963 | Marietta |
| 3,117,484 | A | | 1/1964 | Myers |
| 3,139,624 | A | * | 7/1964 | Humphrey ..... 2/9 |
| 3,166,761 | A | | 1/1965 | Strohm |
| 3,167,783 | A | | 2/1965 | Wolfe |
| 3,186,004 | A | | 6/1965 | Carlini |
| 3,187,342 | A | | 6/1965 | Aileo |
| 3,216,023 | A | | 11/1965 | Morgan |
| 3,263,236 | A | | 8/1966 | Humphrey |
| 3,274,613 | A | | 9/1966 | Sowle |
| 3,283,336 | A | | 11/1966 | Critser |
| 3,327,313 | A | | 6/1967 | Pukish |
| 3,447,162 | A | | 6/1969 | Aileo |
| 3,548,409 | A | | 12/1970 | Aileo |
| 3,548,410 | A | | 12/1970 | Parker |
| 3,609,764 | A | | 10/1971 | Morgan |
| 3,619,813 | A | | 11/1971 | Marchello |
| 3,713,640 | A | | 1/1973 | Margan |
| 3,729,746 | A | * | 5/1973 | Humphrey ..... 2/9 |
| 3,761,959 | A | | 10/1973 | Dunning |
| 3,783,450 | A | | 1/1974 | O'Connor |
| 3,787,895 | A | | 1/1974 | Belvedere |
| 3,793,241 | A | | 2/1974 | Kyle et al. |
| D230,911 | S | | 3/1974 | Ispas, Jr. |
| 3,818,508 | A | | 6/1974 | Lammers et al. |
| 3,849,801 | A | | 11/1974 | Holt et al. |
| 3,854,146 | A | | 12/1974 | Dunning |
| 3,882,547 | A | | 5/1975 | Morgan |
| 3,889,296 | A | | 6/1975 | Martin |
| 3,916,446 | A | | 11/1975 | Gooding |
| 3,934,271 | A | | 1/1976 | Rhee |
| 3,994,020 | A | | 11/1976 | Villari |
| 3,994,021 | A | | 11/1976 | Villari et al. |
| 3,994,022 | A | | 11/1976 | Villari et al. |
| 4,023,213 | A | | 5/1977 | Rovani |
| 4,028,743 | A | | 6/1977 | Christensen |
| 4,044,400 | A | | 8/1977 | Lewicki |
| 4,060,855 | A | | 12/1977 | Rappleyea |
| 4,075,714 | A | | 2/1978 | Ryder et al. |
| 4,101,983 | A | | 7/1978 | Dera et al. |
| 4,136,403 | A | | 1/1979 | Walther et al. |
| 4,233,687 | A | | 11/1980 | Lancellotti |
| 4,272,853 | A | | 6/1981 | Schuessler |
| 4,279,038 | A | | 7/1981 | Bruckner et al. |
| 4,287,613 | A | | 9/1981 | Schulz |
| D267,287 | S | | 12/1982 | Gooding |
| 4,363,140 | A | | 12/1982 | Correale |
| 4,370,759 | A | | 2/1983 | Zide |
| 4,390,995 | A | | 7/1983 | Walck |
| 4,398,306 | A | | 8/1983 | Gooding |
| 4,404,690 | A | | 9/1983 | Farquharson |
| D271,249 | S | | 11/1983 | Farquharson |
| 4,461,044 | A | | 7/1984 | Reiterman |
| 4,475,248 | A | | 10/1984 | L'Abbe et al. |
| 4,477,929 | A | | 10/1984 | Mattsson |
| 4,566,137 | A | | 1/1986 | Gooding |
| 4,633,531 | A | | 1/1987 | Nimmons |
| 4,646,368 | A | | 3/1987 | Infusino et al. |
| 4,651,356 | A | | 3/1987 | Zide |
| 4,677,694 | A | | 7/1987 | Crow |
| 4,692,947 | A | | 9/1987 | Black et al. |
| 4,706,305 | A | | 11/1987 | Cho |
| 4,741,054 | A | | 5/1988 | Mattes |
| 4,744,107 | A | | 5/1988 | Fohl |
| 4,774,729 | A | | 10/1988 | Coates et al. |
| 4,794,652 | A | | 1/1989 | Piech von Planta et al. |
| 4,808,469 | A | | 2/1989 | Hiles |
| 4,831,668 | A | | 5/1989 | Schulz |
| 4,837,866 | A | | 6/1989 | Rector et al. |
| 4,853,980 | A | | 8/1989 | Zarotti |
| 4,866,792 | A | | 9/1989 | Arai |
| 4,885,806 | A | | 12/1989 | Heller |
| 4,885,807 | A | | 12/1989 | Snow, Jr. |
| 4,903,346 | A | | 2/1990 | Reddemann et al. |
| 4,916,759 | A | | 4/1990 | Arai |
| D309,512 | S | | 7/1990 | Crow |
| 4,947,490 | A | | 8/1990 | Hayden |
| 5,014,365 | A | | 5/1991 | Schulz |
| 5,035,009 | A | | 7/1991 | Wingo et al. |
| 5,061,112 | A | | 10/1991 | Monford, Jr. |
| 5,083,321 | A | | 1/1992 | Davidsson |
| 5,093,936 | A | | 3/1992 | Copeland |
| 5,093,939 | A | | 3/1992 | Noyerie et al. |
| 5,101,517 | A | | 4/1992 | Douglas |
| 5,129,108 | A | | 7/1992 | Copeland |
| 5,136,728 | A | | 8/1992 | Kamata |
| 5,142,700 | A | | 8/1992 | Reed |
| D332,507 | S | | 1/1993 | Anderson et al. |
| 5,175,889 | A | | 1/1993 | Infusino |
| 5,177,816 | A | | 1/1993 | Schmidt et al. |
| 5,263,203 | A | | 11/1993 | Kraemer et al. |
| 5,263,204 | A | | 11/1993 | Butsch |
| 5,267,353 | A | | 12/1993 | Milligan |
| 5,293,649 | A | | 3/1994 | Corpus |
| RE34,699 | E | | 8/1994 | Copeland |
| D350,710 | S | | 9/1994 | Keiffer |
| 5,347,660 | A | | 9/1994 | Zide et al. |
| D357,555 | S | | 4/1995 | Brueckner |
| 5,418,257 | A | | 5/1995 | Weisman |
| 5,452,979 | A | | 9/1995 | Cosenza |
| 5,461,730 | A | | 10/1995 | Carrington |
| D364,487 | S | | 11/1995 | Tutton et al. |
| 5,494,323 | A | | 2/1996 | Huang |
| 5,502,843 | A | | 4/1996 | Strickland |
| 5,539,936 | A | | 7/1996 | Thomas |
| 5,553,330 | A | | 9/1996 | Carveth |
| D378,236 | S | | 2/1997 | Zanotto et al. |
| D378,624 | S | | 3/1997 | Chartrand |
| D382,671 | S | | 8/1997 | Shewchenko |
| D383,953 | S | | 9/1997 | DeFilippo |
| 5,675,875 | A | | 10/1997 | Servatius |
| 5,713,082 | A | | 2/1998 | Bassette et al. |
| 5,724,681 | A | | 3/1998 | Sykes |
| 5,732,414 | A | | 3/1998 | Monica |

(56) References Cited

U.S. PATENT DOCUMENTS

| | | | |
|---|---|---|---|
| 5,737,770 | A | 4/1998 | Chen |
| 5,790,988 | A | 8/1998 | Guadagnino, Jr. et al. |
| 5,794,274 | A | 8/1998 | Kraemer |
| 5,799,337 | A | 9/1998 | Brown |
| D406,399 | S | 3/1999 | Hohdorf |
| 5,883,145 | A | 3/1999 | Hurley et al. |
| D408,236 | S | 4/1999 | Rennick |
| 5,915,537 | A | 6/1999 | Dallas et al. |
| 5,930,840 | A | 8/1999 | Arai |
| 5,938,878 | A | 8/1999 | Hurley et al. |
| 5,946,735 | A | 9/1999 | Bayes |
| 5,953,761 | A | 9/1999 | Jurga et al. |
| 5,963,990 | A | 10/1999 | White |
| 5,966,744 | A | 10/1999 | Smith |
| 6,047,400 | A | 4/2000 | Spencer |
| 6,054,005 | A | 4/2000 | Hurley et al. |
| 6,070,271 | A | 6/2000 | Williams |
| 6,073,271 | A | 6/2000 | Alexander et al. |
| 6,079,053 | A | 6/2000 | Clover et al. |
| 6,081,932 | A | 7/2000 | Kraemer |
| 6,128,786 | A | 10/2000 | Maddux |
| 6,138,284 | A | 10/2000 | Arai |
| 6,189,156 | B1 | 2/2001 | Loiars |
| 6,199,219 | B1 | 3/2001 | Silken |
| 6,219,850 | B1 | 4/2001 | Halstead et al. |
| 6,226,801 | B1 | 5/2001 | Alexander et al. |
| D445,962 | S | 7/2001 | Brignone et al. |
| 6,256,798 | B1 | 7/2001 | Egolf |
| 6,272,692 | B1 | 8/2001 | Abraham |
| D448,526 | S | 9/2001 | Brignone et al. |
| 6,282,726 | B1 | 9/2001 | Noyerie et al. |
| D448,890 | S | 10/2001 | Brignone et al. |
| 6,298,483 | B1 | 10/2001 | Schiebl et al. |
| 6,298,497 | B1 | 10/2001 | Chartrand |
| 6,301,719 | B1 | 10/2001 | Goodhand et al. |
| 6,324,701 | B1 | 12/2001 | Alexander |
| D453,399 | S | 2/2002 | Racine |
| 6,360,376 | B1 | 3/2002 | Carrington |
| 6,370,699 | B1 | 4/2002 | Halstead et al. |
| D459,032 | S | 6/2002 | Gatellet |
| D459,554 | S | 6/2002 | Gatellet |
| D459,555 | S | 6/2002 | Gatellet |
| 6,438,762 | B1 | 8/2002 | Jenkins |
| 6,438,763 | B2 | 8/2002 | Guay et al. |
| 6,446,270 | B1 | 9/2002 | Durr |
| D465,067 | S | 10/2002 | Ide et al. |
| 6,481,024 | B1 | 11/2002 | Grant |
| D466,651 | S | 12/2002 | Halstead et al. |
| 6,499,139 | B1 | 12/2002 | Brown |
| 6,499,147 | B2 | 12/2002 | Schiebl et al. |
| D475,486 | S | 6/2003 | Ide et al. |
| 6,701,535 | B2 | 3/2004 | Dobbie et al. |
| D492,818 | S | 7/2004 | Ide et al. |
| D495,838 | S | 9/2004 | Arai |
| 6,826,509 | B2 | 11/2004 | Crisco, III et al. |
| 6,934,971 | B2 | 8/2005 | Ide et al. |
| D509,928 | S | 9/2005 | Barnoski |
| 6,938,272 | B1 | 9/2005 | Brown |
| D511,026 | S | 10/2005 | Ide et al. |
| D512,534 | S | 12/2005 | Maddux et al. |
| 7,146,652 | B2 | 12/2006 | Ide et al. |
| 7,240,376 | B2 | 7/2007 | Ide et al. |
| 7,328,462 | B1 | 2/2008 | Straus |
| D575,458 | S | 8/2008 | Ho |
| D582,607 | S | 12/2008 | Ferrara et al. |
| D587,407 | S | 2/2009 | Nimmons et al. |
| D587,852 | S | 3/2009 | Nimmons |
| D587,853 | S | 3/2009 | Nimmons |
| D587,854 | S | 3/2009 | Nimmons et al. |
| D587,855 | S | 3/2009 | Nimmons et al. |
| D603,099 | S | 10/2009 | Bologna et al. |
| D603,100 | S | 10/2009 | Bologna |
| D616,154 | S | 5/2010 | Daniel |
| D625,050 | S | 10/2010 | Chen |
| D628,748 | S | 12/2010 | Stewart |
| D629,162 | S | 12/2010 | Daniel |
| D633,658 | S | 3/2011 | Daniel |
| 7,954,177 | B2 | 6/2011 | Ide et al. |
| D654,629 | S | 2/2012 | Chou et al. |
| D654,630 | S | 2/2012 | Chou et al. |
| 2002/0104533 | A1* | 8/2002 | Kalhok et al. ..... 128/201.24 |
| 2002/0174480 | A1 | 11/2002 | Lombard |
| 2003/0188375 | A1 | 10/2003 | Wilson |
| 2003/0209241 | A1 | 11/2003 | Fournier |
| 2004/0025231 | A1 | 2/2004 | Ide et al. |
| 2005/0278835 | A1 | 12/2005 | Ide et al. |
| 2007/0151003 | A1 | 7/2007 | Shih |
| 2008/0163410 | A1* | 7/2008 | Udelhofen ..... A42B 3/20 2/413 |
| 2009/0265841 | A1 | 10/2009 | Ferrara |
| 2010/0005573 | A1 | 1/2010 | Rudd et al. |
| 2011/0209272 | A1 | 9/2011 | Drake |
| 2012/0011639 | A1 | 1/2012 | Beauchamp et al. |
| 2012/0079646 | A1 | 4/2012 | Belanger et al. |

FOREIGN PATENT DOCUMENTS

| | | |
|---|---|---|
| DE | 3338188 | 5/1985 |
| DE | 3603234 | 8/1987 |
| DE | 19745960 | 4/1999 |
| EP | 512193 | 11/1992 |
| GB | 256430 | 8/1926 |
| GB | 1354719 | 5/1974 |
| JP | 56-53735 | 5/1981 |
| JP | 57-205511 | 12/1982 |
| JP | 3-22024 | 3/1991 |
| JP | 05-132809 | 5/1993 |
| JP | 5-72922 | 10/1993 |
| JP | 07-109609 | 4/1995 |
| JP | 07-126908 | 5/1995 |
| JP | 10-195707 | 7/1998 |
| JP | 2001-020121 | 1/2001 |
| JP | 59-37323 | 9/2011 |
| WO | WO 95/34229 | 12/1995 |
| WO | WO 01/52676 | 7/2001 |

OTHER PUBLICATIONS

Schutt Photographs (Published Apr. 2001) (Exhibit 1 of Irvin Declaration).

Schutt Sports, 2002 Football Catalog (Exhibit 2 of Irvin Declaration).

Supplemental Declaration of Michael W. Irvin Under 37 CFR § 1.132 and MPEP 2616 dated Dec. 27, 2012.

Rawlings Fall/Winter Sports Catalog 1926-1927.

Expert Report of Mr. Rovani filed Dec. 15, 2009, *Riddell, Inc.* v. *Schutt Sports, Inc.;* U.S. District Court for the W.D. of Wisconsin; 08-cv-711.

Claim Construction Opinion and Order; *Riddell, Inc.* v. *Schutt Sports, Inc.;* U.S. District Court for the W.D. of Wisconsin; 08-cv-711; dated Jul. 10, 2009.

Schutt's Response to Riddell's First Set of Interrogatories; including patent invalidity contentions and exhibit with invalidity claim charts; dated Mar. 13, 2009.

Schutt's Answer and Affirmative Defenses; *Riddell, Inc.* v. *Schutt Sports, Inc.;* U.S. District Court for the W.D. of Wisconsin; 08-cv-711; dated Feb. 16, 2009.

Plaintiff Riddell's Brief in Support of Proposed Claim Constructions; dated Apr. 29, 2009.

Plaintiff Riddell's Opinion Brief to Defendant Schutt's Proposed Claim Constructions; dated May 18, 2009.

Defendant Schutt's First Supplemental Responses to Plaintiff Riddell's First Set of Interrogatories.

Four Photographs of Riddell, Inc.'s VSR4 football helmet which was commercially available prior to May 1, 2001.

U.S. Appl. No. 10/151,245, filed May 21, 2002, Lombard.

Face-Off Lacrosse Yearbook 2003, Spring 2003, three pages, vol. 10.

Declaration of co-inventor Thad M. Ide, dated Oct. 28, 2004, 2 pages, with photographs of seven (7) helmets bearing labels A1-A6, B1-B5, C1-7, D1-D5, El -E5, F1-F5, G1-G5, 22 pages, (commercialy available prior to Apr. 29, 2003) see p. 2 of declaration.

(56) References Cited

OTHER PUBLICATIONS

Newman, James A., "A Proposed New Biochemical Head Injury Assessment Funcation—The Maximum Power Index", Stapp Paper No. OOS-80, 44th Stapp Car Crash Conference Proceedings—Copyright 2000 the Staff Association; published prior to (critical date) Sep. 8, 2005 (Abstract only).

Newman, James, "A New Biochemical Assessment of Mild Traumatic Brain Injury Part 2—Results and Communications", published prior to (critical date) Sep. 8, 2005 (Abstract only).

Newman, James, "A New Biochemical Assessment of Mild Traumatic Brain Injury Part 1—Methodology", published prior to (critical date) Sep. 8, 2005 (Abstract only).

* cited by examiner

PROTECTIVE SPORTS HELMET

CROSS-REFERENCE TO RELATED APPLICATIONS

This application is a continuation-in-part of pending U.S. patent application Ser. No. 12/082,920, filed on Apr. 15, 2008, now U.S. Pat. No. 8,813,269, issued on Aug. 26, 2014, which claims the benefit of Provisional Patent Application No. 60/923,603, filed on Apr. 16, 2007; and this application also claims the benefit of Provisional Patent Application No. 61/343,567, filed on Apr. 30, 2010, all of these applications are incorporated herein by reference and made a part hereof.

FEDERALLY SPONSORED RESEARCH OR DEVELOPMENT

N/A

TECHNICAL FIELD

The invention generally relates to a protective sports helmet, such as a football, lacrosse, hockey or baseball helmet, worn by a player during the play of a contact sport. The inventive helmet includes a number of improvements, including but not limited to an energy attenuating faceguard mounting system that reduces impact forces received by a faceguard secured to the helmet.

BACKGROUND OF THE INVENTION

Helmets for contact sports, such as those used in football, hockey and lacrosse, typically include a shell, an internal padding assembly, a faceguard or face mask, and a chin protector or strap that removably secures the helmet on the wearer's head. The faceguard is rigidly secured to the shell by a plurality of connectors, whereby the faceguard can sustain a number of impacts during the course of play while remaining connected to the shell. Most faceguards include a plurality of intersecting and/or overlapping bars that form openings through which the wearer views the field of play. With conventional helmets, the upper faceguard bars directly contact the lower frontal portion of the helmet shell, which is referred to as the "brow region" of the shell. This direct contact results from the use of a pair of connectors secured to the brow region of the helmet shell. Additional connectors are employed to secure the faceguard to the side portions of the helmet shell. Conventional faceguard connectors are purposely designed to avoid flexing when the faceguard receives an impact force.

One existing faceguard connector is a plastic U-shaped strap member that has a receiver portion that encircles a bar of the faceguard. This strap connector includes a tab portion, wherein a threaded fastener, such as a screw, extends through the tab portion and into the shell to secure the connector and the faceguard to the helmet. Typically, these U-shaped strap connectors are found above the brow region of the shell and along each ear flap to join the faceguard to the shell. A second existing faceguard connector is disclosed in U.S. Pat. No. 6,934,971, which is owned by Riddell Inc., the assignee of the present application. That connector, marketed under the Isolator System brand name, includes a nut, a bushing, a grommet, a rectangular bracket and a threaded fastener (screw). The bracket includes a first channel that receives a first bar of the faceguard and a second channel that receives a second bar, wherein the faceguard bars are positioned between the shell and the bracket. The fastener extends through the bracket and the shell and is received by the nut (residing within the shell) to couple the faceguard to the shell. The threaded fastener is employed to secure the connector to the shell and as a result, a rotational force is applied to tighten for securement and loosen the fastener to permit removal of the bracket and faceguard. While such conventional faceguard connectors provide a number of benefits, they nevertheless have certain limitations. For example, adjusting and/or removing the faceguard from the shell can be difficult and time consuming. Because a threaded fastener is utilized, rotation of a flat-blade or Phillips screwdriver is required to loosen the fastener to allow for removal of the bracket and the faceguard. Removal of a faceguard becomes necessary when the player is injured or the player's faceguard is damaged and involves unscrewing the fastener to allow for removal of both the connector and the damaged faceguard. After the damaged faceguard is removed, a replacement faceguard is secured to the helmet with the fastener and connector. This removal and replacement process is time consuming and requires that the player having the damaged equipment to be removed from play until the process is completed. The unavailability of the player to participate in further play is detrimental to the team, especially if the player plays an essential position such as quarterback.

One additional limitation of the use of a faceguard connector above the brow region of the shell is the transmission of faceguard impact forces. Because the faceguard is in direct contact with the shell, a significant extent of a faceguard impact force is transmitted from the faceguard to the shell. Depending upon its severity and magnitude, an extent of the impact force may be transmitted through the internal padding assembly to the wearer of the helmet.

The present invention is provided to solve these limitations and to provide advantages and aspects not provided by conventional sports helmets. A full discussion of the features and advantages of the present invention is deferred to the following detailed description, which proceeds with reference to the accompanying drawings.

SUMMARY OF THE INVENTION

The present invention is directed to a protective sports helmet that includes a number of improvements intending to increase the protective nature of the helmet. For example, the helmet features an energy attenuating faceguard mounting system, which includes at least one dynamic connector that secures the faceguard (or face mask) to the helmet shell without a connection point to the shell's brow region. The lack of a brow region connection point results in a gap or clearance between the faceguard and the shell that has a functional interplay with the dynamic connector upon an impact to the faceguard.

While it is the desire and goal that a football helmet, and other types of protective helmets, prevent injuries from occurring, it should be noted that as to the helmet of the present invention, as well as prior art helmets, due to the nature of contact sports (including football), no protective equipment or helmet can completely prevent injuries to those individuals playing sports. It should be further noted that no protective equipment can completely prevent injuries to a player, especially when the player uses the equipment improperly and/or employs poor form or technique. For example, if the football player uses his football helmet in an improper manner, such as to butt, ram, or spear an opposing player, which is in violation of the rules of football and severe head and/or neck injuries, paralysis, or death to the football player, as well as possible injury to the football player's opponent can result. No football helmet, or protective helmet, such as that of the present invention, can prevent head, chin, or neck injuries a football player might receive while participating in the sport of football. The helmet of the present invention is believed to offer protection to football players, but it is believed that no helmet can, or will ever completely prevent head injuries to football players.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

Figure 1:
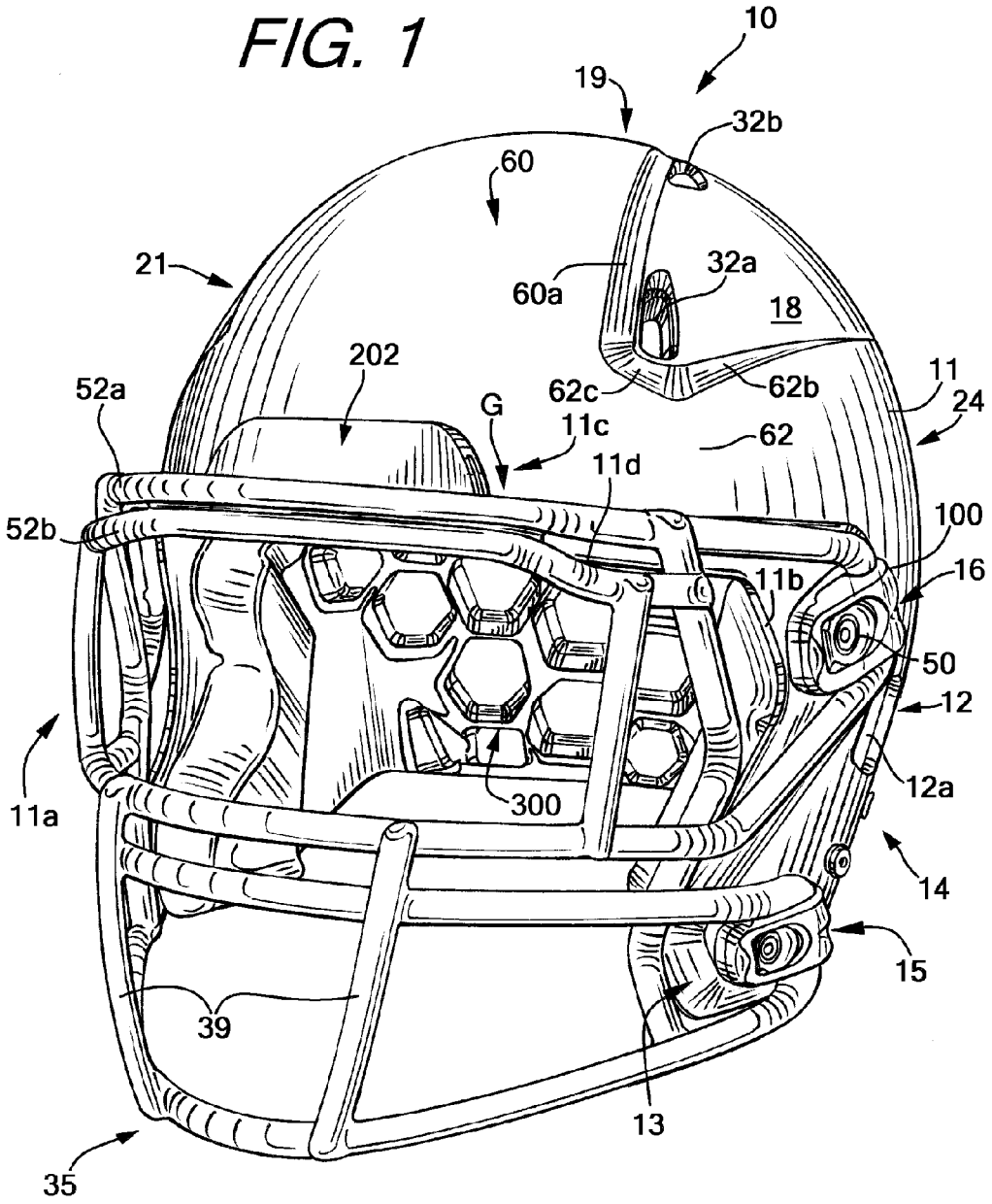
FIG. 1 is a perspective view of an embodiment of a sports helmet having an energy attenuating system of the invention, the system including a faceguard and a dynamic faceguard connector assembly.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
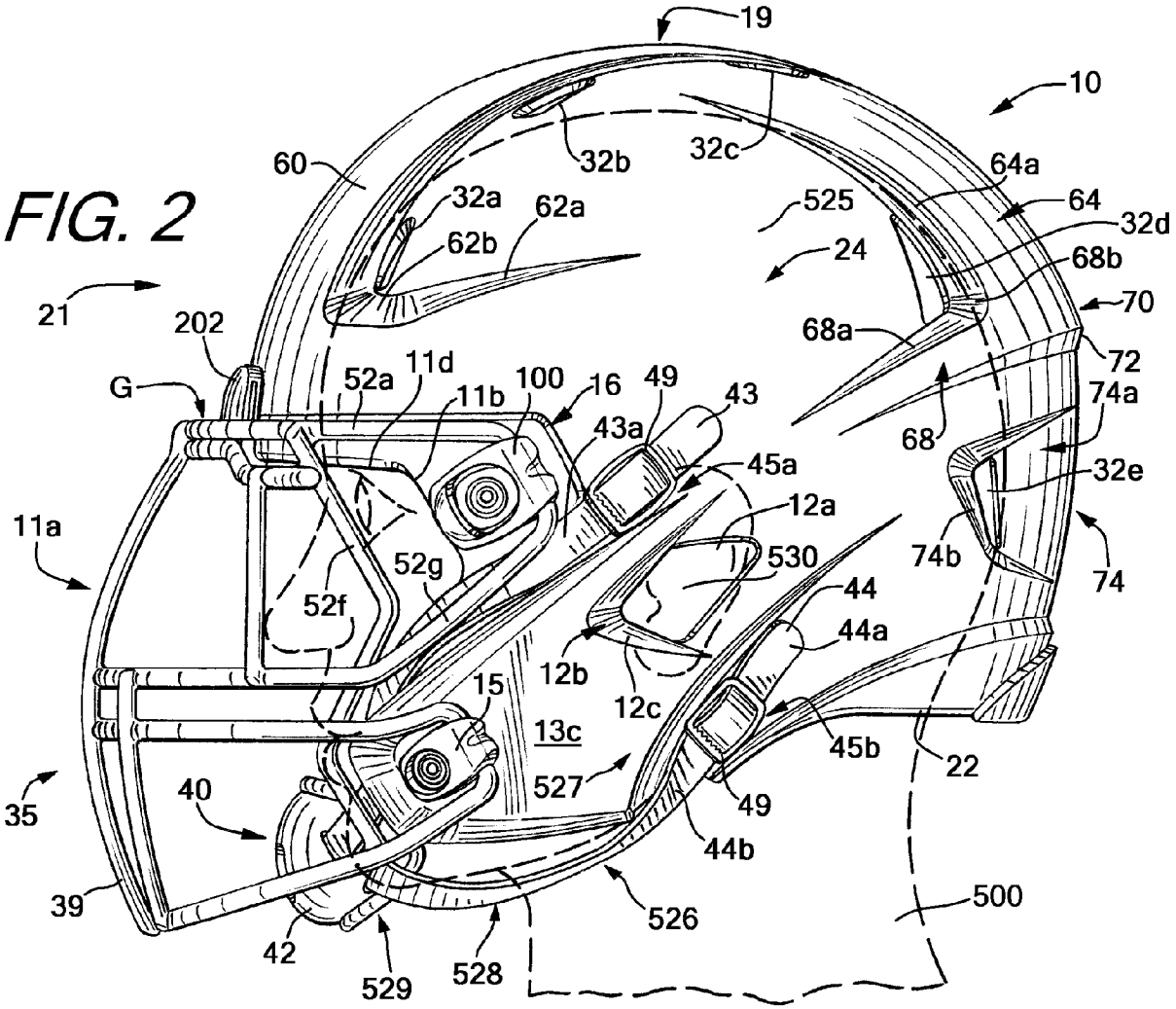
FIG. 2 is a side view of the helmet of FIG. 1, including a wearer of the helmet being partially shown in phantom lines.

In the Figures, a football helmet 10 in accordance with the present invention is shown to generally include: an outer shell 11 with an ear flap 12 and a jaw flap 13, an energy attenuating faceguard mounting system 14 comprising a faceguard 35 that spans a frontal shell opening 11*a* and at least one dynamic faceguard connector 16, and an internal padding assembly 300. The outer shell 11 is preferably made of a suitable plastic material having the requisite strength and durability characteristics to function as a football helmet, or other type of protective helmet, such as polycarbonate plastic materials, one of which is known as LEXAN®, as is known in the art. Alternatively, the shell is made from a fiber reinforced plastic resin, wherein carbon fibers are utilized. Outer shell 11 has an inner wall surface 17 (FIG. 12) and an outer wall surface 18. Referring to FIGS. 1-3, the shell 11 further includes a crown 19, a back 20, a front 21, a lower edge surface 22, and two side regions 24 (which include the ear flap 12 and jaw flap 13). As is known in the art, and as will be hereinafter described in greater detail, shell 11 is adapted to receive the head 525 of a wearer 500 of the helmet 10. Referring to FIG. 2, the wearer or player 500 has a jaw or mandible 526 (FIG. 2) that generally comprises a substantially vertical ramus portion 527, a body or side portion 528, and a frontal or mental protruberance or chin portion 529. As shown in FIG. 2, the body portion 528 extends between the ramus portion 527 and the chin 529. The ramus portion 527 includes an upper segment with coronoid and condyloid processes that are proximate and forward of ears 530 of wearer 500.

With reference to FIGS. 1, 2, 11 and 19, each side region 24 of the shell 11 includes an ear flap 12, which is adapted to generally overlie an ear 530 (FIG. 2) and portion of a cheek of the wearer 500. Each ear flap 12 generally extends downwardly from the side region 24 to the lower edge surface 22 of shell 11. Each ear flap 12 includes a jaw flap 13 that extends from its corresponding ear flap 12 forwardly toward the front 21 of the shell 11. As seen in FIG. 2, the jaw flap 13 is adapted to generally extend to overlie a portion of the body portion 528 of the jaw 526 of the wearer 500 of the helmet 10. As shown in FIG. 2, jaw flap 13 extends forwardly to overlie a forwardly disposed portion of the jaw 526 disposed toward the chin 529 of wearer 500. The jaw flap 13 extends forwardly enough to overlie a portion of the side of the chin 529 of wearer 500, but not the entire chin 529. The jaw flap 13 does not need to extend to completely cover the chin 529 of the wearer 500, but it is contemplated that it may extend to completely cover the chin 529 in some embodiments, or based on the specific anatomy of some wearers. It is further contemplated that the jaw flap 13 will not cover any portion of the chin 529 of the wearer 500 in other embodiments, or based on the specific anatomy of some wearers. In this regard, it should be noted that helmets 10 of the present invention are generally made with outer shells 11 of varying sizes, dependent upon the size of the head of the particular wearer of the helmet. It is also noted that players are fitted for helmets by trained personnel in accordance with written fitting guidelines. In FIG. 2, a properly-sized helmet 10 is shown superimposed upon what is believed to be an average size head of a wearer of the helmet 10, whereby jaw flap 13 is shown to generally overlie the entire ramus 527 of the jaw 526 and at least some of the body portion 528 of the jaw 526, including a forwardly disposed portion of jaw 526 adjacent the chin 529 of wearer 500, including overlying at least some portion of the side of the chin 529 of wearer 500. Since FIG. 2 is not a representation of all sizes of heads and all types of chin structures, such as chins which may greatly extend outwardly away from the head of the wearer, it should be understood that it is perhaps possible that someone wearing a helmet 10 in accordance with the present invention may have a larger or smaller side portion of his or her chin extending outwardly further beyond the outer periphery of jaw flap 13. When the helmet 10 is properly sized and fitted to the wearer 500, it is believed that jaw flap 13 will overlie some portion of the body 528 of the jaw 526 of virtually all wearers of helmets 10.

Figure 11:
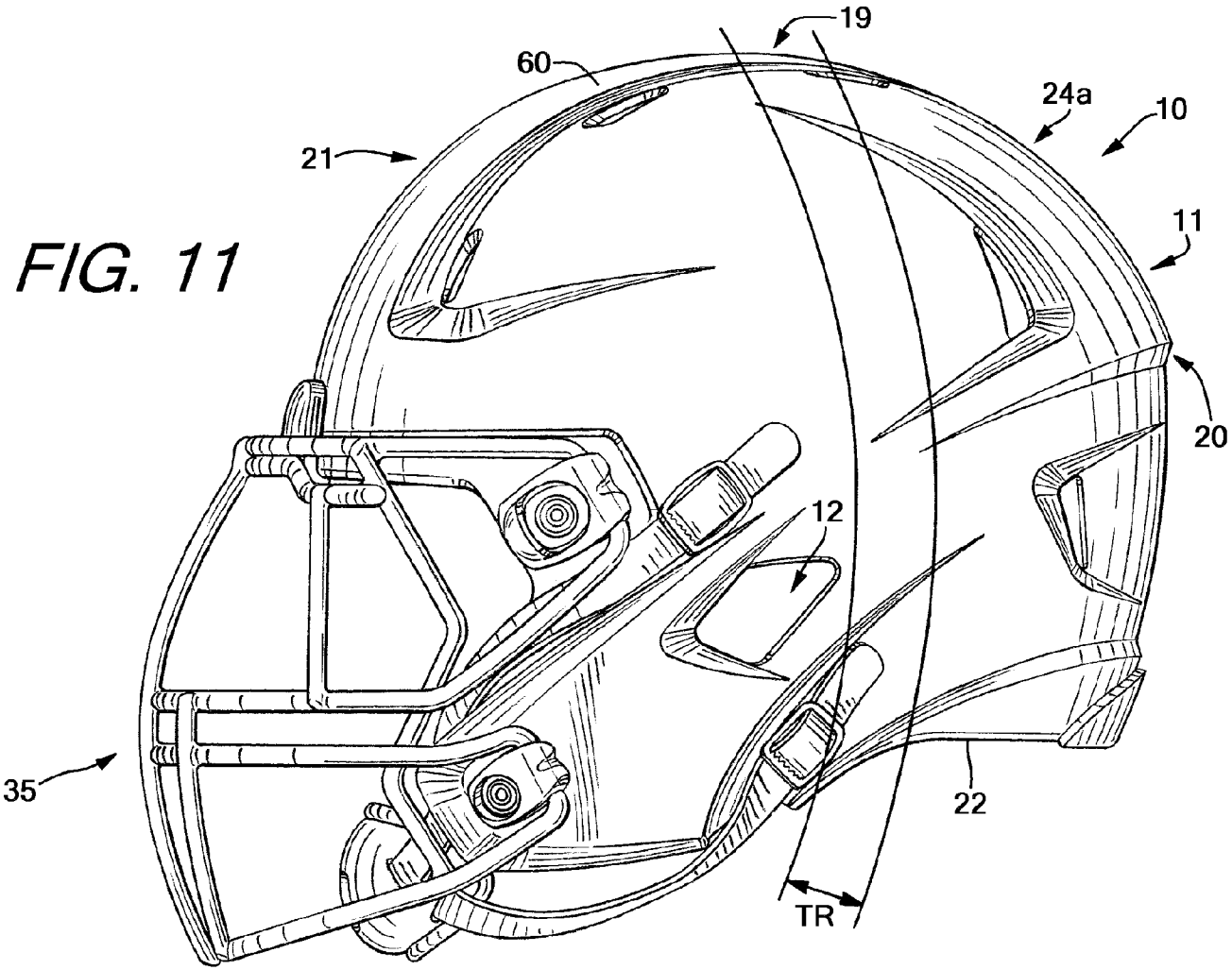
FIG. 11 is a side view of the helmet of FIG. 1 showing a transitional region of the shell.
Figure 12:
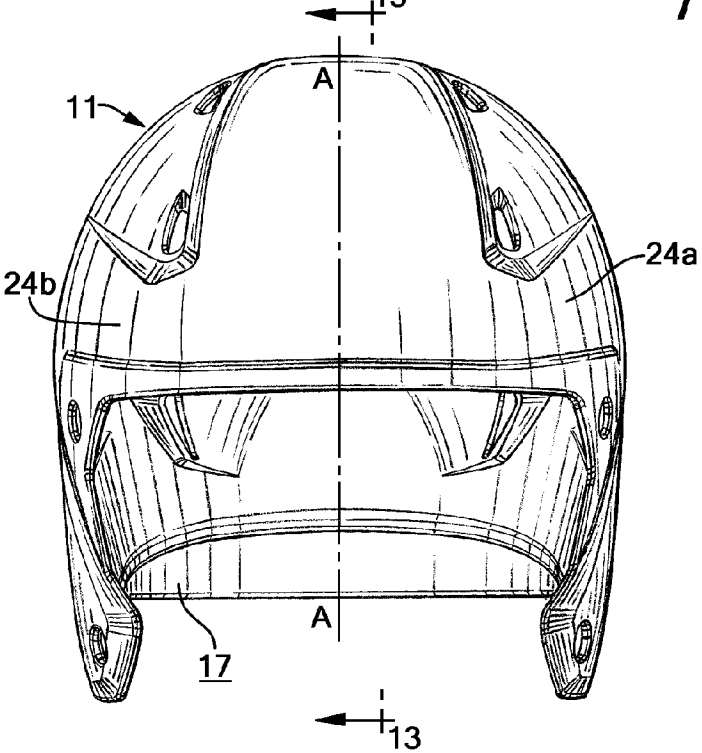
FIG. 12 is a front view of the helmet shell of FIG. 1.

As shown in the Figures, the helmet shell 11 has an arrangement of complex contours. Referring to FIGS. 1, 2, 11 and 12, the shell 11 has a raised central band 60 extending rearward from the front shell portion 21 and along the crown 19. The raised central band 60 has an initial frontal width that is reduced as the band 60 extends rearward through the crown 19. In one embodiment, the initial frontal width is approximately 5 to 6 inches. Also, the band 60 has an initial frontal height defined by a beveled (or inclined) sidewall 60*a* that is reduced along the band 60, whereby a rear segment of the band 60 is substantially flush with the outer surface 18 of the shell 11, preferably being flush rearward of a midpoint of the crown 19. A pair of opposed front ridges 62 extend transversely and substantially upward from the band 60 and towards the ear flap 12. As shown in FIG. 1, the ridge 62 has an initial frontal height defined by a first beveled sidewall segment 62*a* that extends downwardly from the band 60 and a second beveled sidewall segment 62*b* that extends laterally and upwardly towards the ear flap 12. Due to its upward extension, a midpoint of the second sidewall segment 62*b* is approximately 1.5 to 2 inches above the uppermost faceguard bar 52*a* and the frontal opening upper edge 11*d*. Preferably, the sidewall segment 62*b* is reduced along the ridge 62, whereby a peripheral segment of the ridge 62 is substantially flush with the outer shell surface 18. Most preferably, the ridge 62 is flush with the outer shell surface 18 at a point that is rearward of the dynamic connector 16, substantially aligned with the upper chin strap connector 45*a*, and/or substantially aligned with the angled frontal ridge 12*b* of the ear opening 12*a*. As shown in FIGS. 2, 11 and 12, a first set of ventilation openings, or air vents, 32*a-c*, are arranged along the side wall 60*a* of the band 60. Although only the left half of the helmet 10 is shown in FIGS. 11 and 12, the helmet 10 is symmetric and it is understood that the structures and features shown on the left half, including openings 32*a-c* along the right side wall of the band 60, are also present on the right half (not shown) of the helmet 10. Preferably, the openings 32*a*, 32*b*, 32*c* in the first set on the left half of the helmet 10 are collinear with each other, and the openings in the second set (on the right half of the helmet 10) are also collinear with each other. Because the band 60 has a rearward taper, the distance between opposed openings 32*a*, 32*b*, 32*c* in the first and second sets, as measured across the band 60, decreases. The initial frontal opening 32*a* is adjacent to an inner shoulder of the ridge 62 and the band 60.

Figure 17:
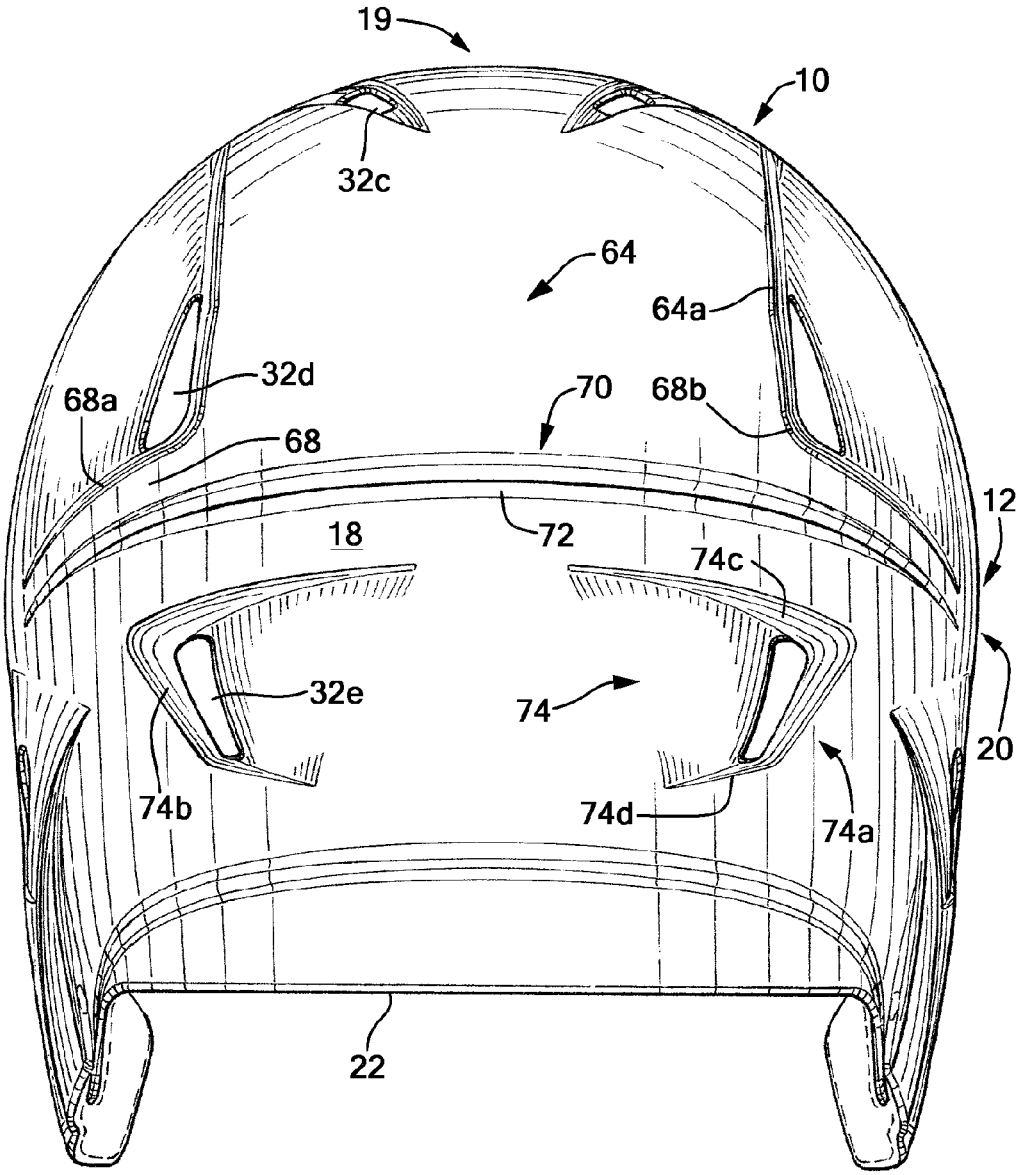

Referring to FIGS. 2 and 17, the shell 11 further includes a raised rear band 64 that extends from the crown 19 rearward to the rear shell portion 20. The raised rear band 64 has a width that remains substantially constant as the band 64 extends rearward and downward. The rear band 64 also has opposed beveled (or inclined) sidewalls 64*a* that increases as the band 64 extends rearward. An initial segment of the band 64 commences forward of the rearmost opening 32*c* and is substantially flush with the shell 11. A pair of opposed rear beveled ridges 68 extend outward and downward from a rear segment of the band 64. The rear beveled ridges 68 have sidewalls 68*a* that decrease along their length whereby the ridges 68 gradually blend into the shell 11. A ventilation opening 32*d* resides adjacent an inner shoulder 68*b* between the ridges 68 and the band 64. Preferably, the ventilation opening 32*d* has a triangular configuration. The rear band 64 terminates proximate a substantially horizontal ledge 70 that extends between the side regions 24 of the helmet 10. The substantially horizontal ledge 70 includes an angled surface 72 extending between the rear band 64 and the outer shell surface 18. Below the ledge 70, the rear shell portion 20 includes a pair of recessed regions 74 in an opposed positional relationship. The recessed region 74 is defined by an arrangement of angled walls 74*a* that form a generally U-shaped configuration. A rear opening 32*e* resides adjacent a frontal or leading wall 74*b* of the angled walls 74*a* and between an upper transverse wall 74*c* and a lower transverse wall 74*d*. The rear opening 32*e* has an elongated configuration with a major axis that is substantially vertical when the helmet 10 is positioned on the wearer's head. Further, the rear opening 32*e* has an upper width that exceeds a lower width.

Figure 3A:
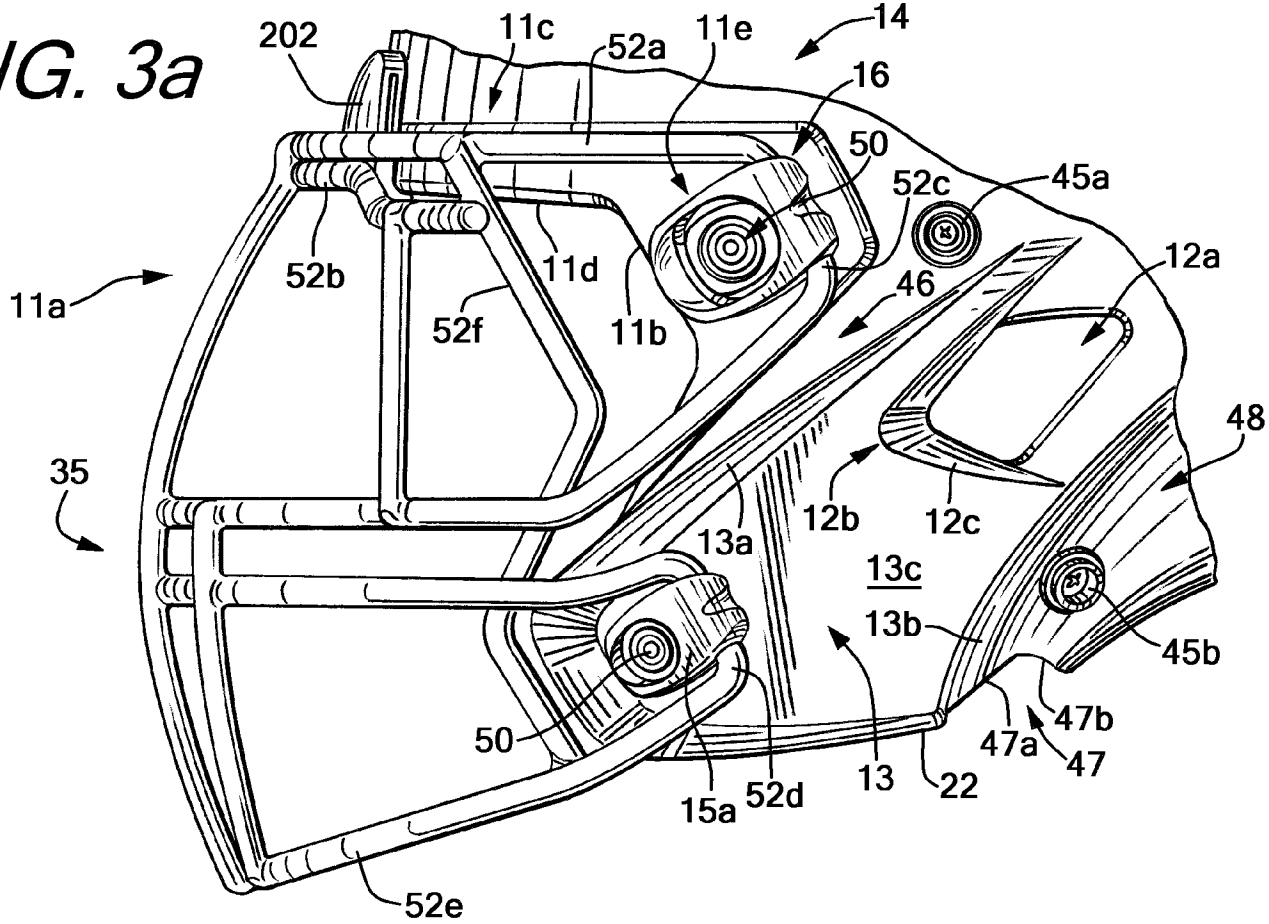
FIG. 3*a* is a side view of a portion of the helmet of FIG. 1 showing the energy attenuating system of the helmet.

With reference to FIGS. 2 and 3*a*, the helmet 10 includes a chin protector 40 that engages the chin 529 of wearer 500 and couples with the shell 11 in order to secure the helmet 10 on the wearer's head. The chin protector 40 includes a central protective member 42 that engages the wearer's chin 529 and at least two flexible members or straps 43, 44 extending from the central member 42. In use, the upper flexible member 43 engages with an upper connector 45*a* extending outward from the shell 11 above an ear opening 12*a* in the ear flap 12 and preferably rearward of the faceguard connector 16. Similarly, the lower flexible member 44 engages with a lower connector 45*b* extending outward from the shell 11 below the ear opening 12*a*. A frontal portion of the ear opening 12*a* is defined by an angled frontal ridge 12*b* with a beveled side wall 12*c* (see FIG. 3*a*). An upper recessed channel 46 extends rearward from an interior frontal edge 11*b* of the shell frontal opening 11*a* and along the upper periphery of the jaw flap 13. The upper recessed channel 46 is adjacent an upper beveled surface 13*a* of the jaw flap 13 (see FIG. 3*a*), and the upper connector 45*a* is aligned with the upper recessed channel 46. A peripheral downwardly extending transverse bar 52*g* is cooperatively dimensioned with the upper channel 46 such that an upper flexible member 43 of the chin protector 40 is positioned between the transverse bar 52*g* and the upper channel 46. A lower recessed channel 48 extends from the lower edge 22 of the shell 11 upward and rearward along the lower periphery of the jaw flap 13. The lower recessed channel 48 is adjacent a lower beveled surface 13*b* of the jaw flap 13, and the lower connector 45*b* is aligned with the lower recessed channel 48. Due to the recessed nature of the upper and lower channels 46, 48, the jaw flap 13 defines an outermost jaw flap surface 13*c* of the shell 11 in the side region of the helmet 10. The shell 11 also includes a notch 47 formed in the lower edge shell surface 22 and below the ear opening 12*a*, and preferably, the notch 47 is aligned with the lower channel 48. Preferably, notch 47 has at least one angled segment 47*a* and potentially a plurality of angled segments 47*a, b* that result in a generally V-shaped configuration; however, other shapes of notches, if desired, could be utilized.

Each flexible member 43, 44 includes a coupler 49 with a female snap connector that engages with the male upper and lower connectors 45*a, b*, respectively, to define a secured position. When the chin protector 40 is in a secured position and the helmet 10 is on the wearer's head 500 (see FIG. 2), the upper channel 46 receives an extent 43*a* of the upper flexible member 43 and the lower channel 48 receives an extent 44*a* of the lower flexible member 44. Thus, in the secured position, the upper and lower flexible members 43, 44 are retained within the upper and lower channels 46, 48, respectively. In addition, a second extent 44*b* of the lower flexible member 44 passes through notch 47 which improves stability of the lower flexible member 44 while minimizing undesired movement of the member 44. In general, if a helmet is subjected to a downward impact force upon the face mask, the helmet tends to roll forwardly about a virtual pivot point located slightly above the ear openings. Notch 47 assists in resisting the undesired rolling effect by redirecting the lower flexible member's 44 line of action to a location farther away from the virtual pivot point. In addition, the securement configuration resulting from the channels 46, 48 and the notch 47 provide an improvement over the conventional 4 point hookup, or a "high hookup," of the chin protector because of improved stability of the helmet 10 on the wearer's head during play. Thus, the retention and proper positioning of the helmet 10 upon impact(s) is improved.

Referring to FIGS. 1, 2, 3*a-c*, and 6-10, the helmet 10 features an energy attenuating faceguard mounting system 14, including the faceguard 35 and means for dynamically connecting the faceguard 35, which interact to reduce impact forces received on the faceguard 35 and transmitted to the helmet shell 11. Unlike conventional sports helmets and faceguard connectors 15, the energy attenuating faceguard mounting system 14 does not include a connection point with a front bumper 202 at the brow region 11*c* of the shell 11 for the faceguard 35. In one embodiment, the dynamic faceguard connecting means comprises a helmet shell connection segment that is movable relative to the remaining shell 11 and that receives a coupler for securement of the faceguard 35. The helmet shell connection segment can be integrally formed within the shell 11, for example in the ear flap 12. Alternatively, the helmet shell connection segment can be formed separately and then operatively joined to the shell 11. For example, the shell 11 can include a generally circular opening that receives and operatively connects with the helmet shell connection segment. The helmet shell connection segment can function similar to a butterfly valve where the connection segment includes a disc that is secured to the shell 11 by a rod and a peripheral region 38 of the faceguard 35 is secured to the rod either directly or via an actuator. When an impact force is applied to the faceguard 35, a portion of the connection segment, for example the disc, moves or rotates relative to the remaining shell 11 which allows for movement of the peripheral faceguard region 38. Alternatively, the helmet shell connection segment can flex inward and/or outward when the impact force is applied to the faceguard 35. In another embodiment, the dynamic faceguard connecting means comprises a plunger assembly coupled to the helmet shell 11 wherein a first plunger component moves relative to the shell 11 (e.g., substantially normal to the shell 11) when an impact force is applied to the faceguard 35. The movement of the plunger assembly facilitates movement of the faceguard 35, including a peripheral faceguard region 38, when the impact force is received by the faceguard 35. In another embodiment, the dynamic faceguard connecting means comprises the dynamic faceguard connector 16. Referring to FIGS. 1-3*a* and as explained below, the helmet 10 includes two dynamic connectors 16, one on each side region 24 of shell 11 positioned slightly above the ear opening 12*a*. The helmet 10 also includes a pair of lower (non-dynamic) connector 15 positioned on the jaw flap 13 near the lower shell edge 22. Alternatively, the helmet 10 may include a greater number of dynamic connectors 16, for example, four dynamic connectors 16 wherein the helmet 10 has a pair of upper dynamic connectors 16 and a pair of lower dynamic connectors 16.

The faceguard 35 comprises a plurality of elongated bar members 39, which may be formed of any suitable material having the requisite strength and durability characteristics to function as a football helmet faceguard. The members 39 may be preferably formed of a metallic material, such as steel or titanium, and as is known in the art, the bar members 39 may be provided with a durable coating (e.g., plastic coating). Additionally, the bar members 39 may be of a solid or tubular cross-sectional configuration. Alternatively, bar members 39 may be formed of a suitable plastic material, including a fiber reinforced plastic resin, having the requisite strength and durability characteristics to perform the functions of a football helmet faceguard. The faceguard connectors 15,16 encircle portions of the bar members 39 of the faceguard 35. The faceguard connectors 15, 16 are shown with a quick release coupler 50, which is described in more detail in pending U.S. patent application 12/082,920, which is incorporated herein by reference. Alternatively, an elongated fastener, such as a threaded screw, may be employed with the faceguard connectors 15, 16 to secure the faceguard 35 to the helmet 10.

Referring to FIGS. 2 and 3*a*, a pair of dynamic faceguard connectors 16 connect an upper portion of the faceguard 35 to an interface area 11*e* of the shell 11 at the ear flap 12 and over a superior (or frontal) portion of the helmet wearer's temporal lobe. Preferably, the faceguard connector 16 is positioned adjacent the interior edge 11*b* of the frontal shell opening 11*a* and below an upper edge 11*d* of the frontal opening 11a. More preferably, the faceguard connector 16 is positioned above the ear opening 12*a* and the jaw flap 13. The dynamic faceguard connectors 16 define an uppermost face guard securement point located over the helmet wearer's superior temporal lobe and lateral to the brow region 110 of the shell 12. The uppermost faceguard securement point is also below the frontal opening upper edge 11*d* and upper substantially horizontal bar 52*a* of the faceguard 35, and above the ear opening 12*a* and jaw flap 13. At least one horizontal upper bar 52*a* of the faceguard 35 extends between the dynamic faceguard connectors 16 and the opposed face guard securement points provided by the dynamic connectors 16. A second substantially horizontal upper bar 52*b* is proximate and below the upper bar 52*a* and extends between transverse intermediate bars 52. Alternatively the transverse intermediate bars 52*f* are omitted and the second upper bar 52*b* is joined with the first upper bar 52*a*. Both of the upper bars 52*a,b* are offset from the shell 11 and do not contact the brow region 110 (or front region) of the shell 11. In other words, the upper bars 52*a, b* extend between the connectors 16 and along the brow region 110 without connecting to the brow region 110. Thus, at least the uppermost bar 52*a* spans frontal opening 11*a* and the distance between the dynamic connectors 16 without connecting to the nameplate (or front bumper) 202 affixed to the brow region 110. Accordingly, the brow (front) region 110 of the shell 11 lacks a faceguard connector. The upper bars 52*a, b* have a length with a curvilinear configuration that substantially corresponds to the curvilinear configuration of the brow region 110 of the shell 11. The offset between the upper bars 52*a, b*, and the shell 11 forms a gap G or standoff (see FIGS. 5 and 6) that is generally greater than 0.25 inch, and preferably between 0.25 inch and 0.5 inch. Unlike the present invention, conventional helmets include a faceguard that is secured to the helmet by at least one connector, typically a pair of connectors, coupled to the helmet's brow region whereby at least one upper bar, typically two upper bars contact the brow region. Conventional faceguards are further secured by at least one additional pair of connectors, each being coupled to an ear flap of the shell.

Figure 10:
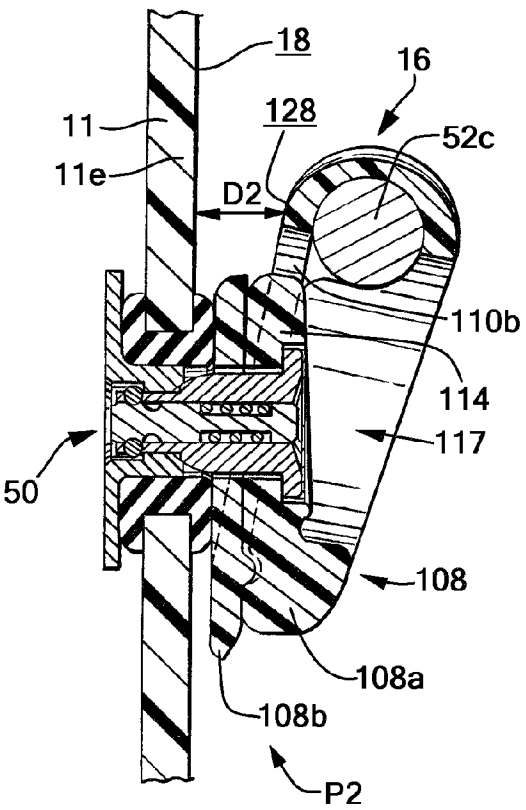
FIG. 10 is a cross-sectional view of the dynamic faceguard connector assembly affixed to the helmet of FIGS. 7 and 8 and shown within dotted lines 10.
Figure 9A:
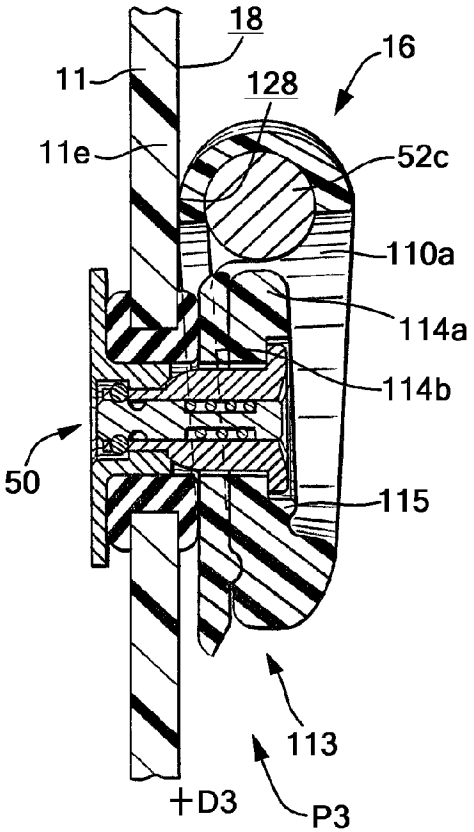
FIG. 9*a* is a cross-sectional view of the dynamic faceguard connector assembly affixed to the helmet of FIG. 8 and shown within dotted lines 9*a;*
Figure 9:
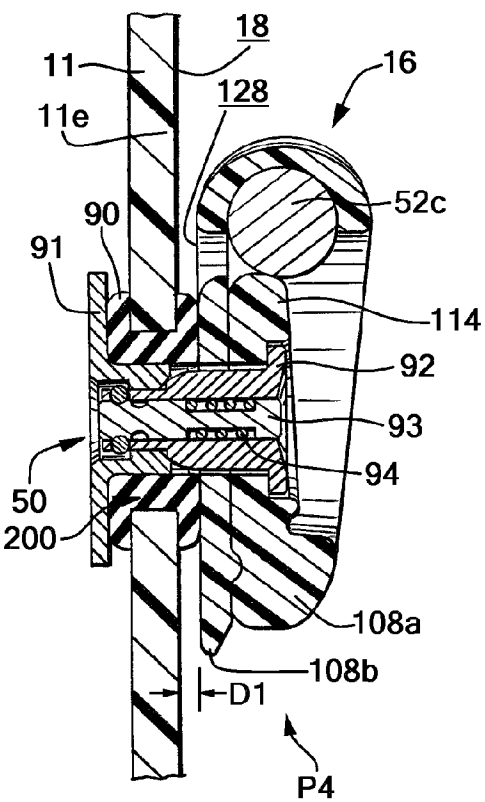
FIG. 9 is a cross-sectional view of the dynamic faceguard connector assembly affixed to the helmet of FIG. 6 and shown within dotted lines 9.

Referring to FIGS. 9, 9*a* and 10, the dynamic connector 16 includes the quick release coupler 50 that extends through a grommet 90 positioned within a shell opening 200. The coupler 50 is received by a fastening washer 91 that extends through both the grommet 90 and the shell opening 200. As explained in pending U.S. patent application Ser. No. 12/082,920, which is incorporated by reference, the quick release coupler 50 also comprises sleeve body 92, an actuator or pin 93, and a spring 94. The sleeve body 92 receives the actuator 93 to removably secure the dynamic connector 16 to the shell 11. As briefly explained above, the quick release coupler mechanism 50 is employed to secure the dynamic faceguard connectors 16 to the shell 11. The coupler mechanism 50 that provides for rapid attachment and detachment of the connectors 16 and the faceguard 35 from the shell 11 without the deliberate and time-consuming use of a screwdriver (or cutting tool for removal). The releasable coupler mechanism 50 extends through the opening 120 in the bracket 100 and into a shell opening 200. The coupler mechanism 50 further includes a head, a washer, ball, and a retaining notch. The coupler 50 is retained in a use position (see FIG. 9) by the engagement between the ball, the retaining notch and the distal end segment of the pin. To move the coupler 50 the use position through an intermediate position to a disconnected position, an inwardly directed actuation force is applied to the pin by an object. Once these internal coupler components are disconnected, the bracket 100 can be removed to allow for removal of the faceguard 35 to arrive at the disconnected position.

Figure 3C:
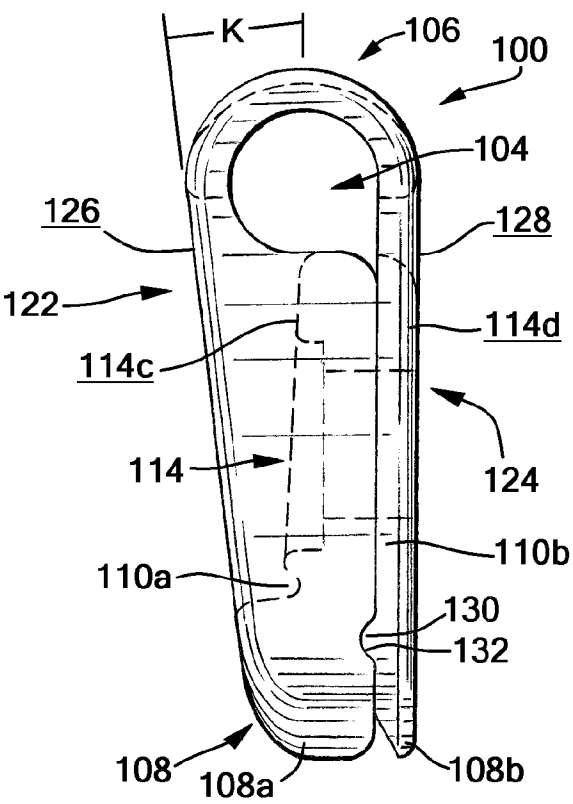
FIG. 3*c* is a side view of the dynamic faceguard connector of the energy attenuating system of the helmet of FIG. 1.
Figure 3B:
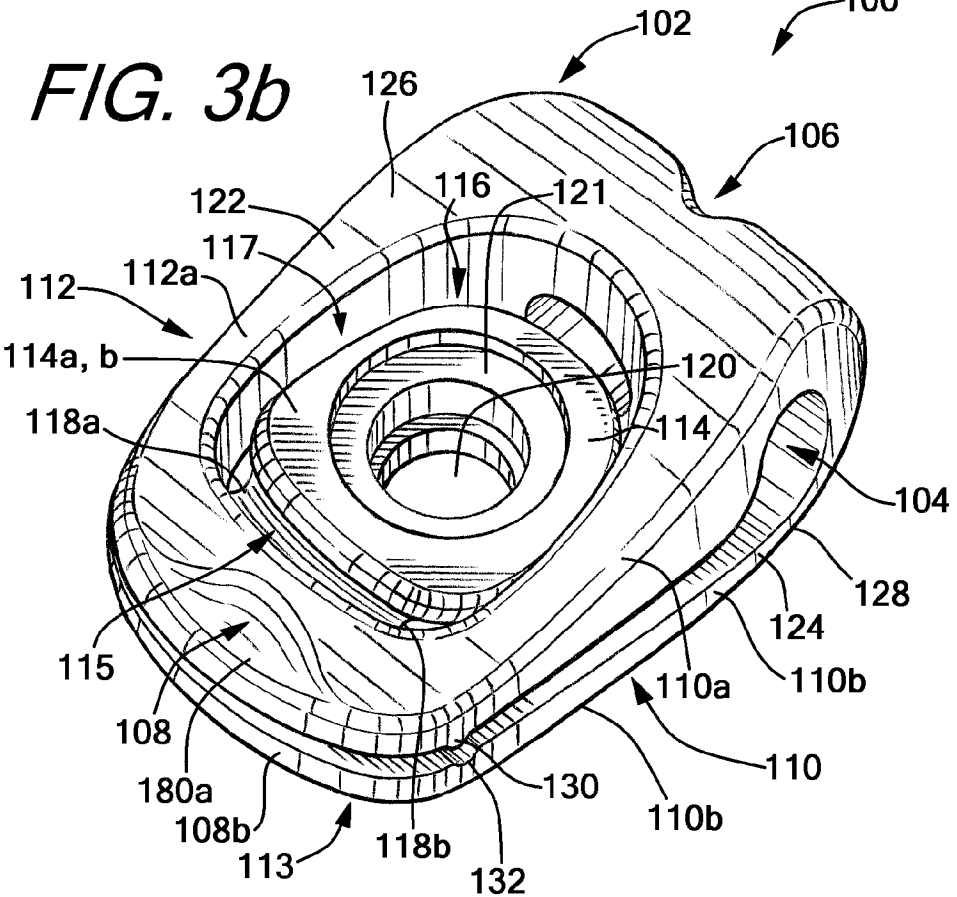
FIG. 3*b* is a perspective view of the dynamic faceguard connector of the energy attenuating system of the helmet of FIG. 1.

As shown in FIGS. 3*a*-3*b*, the dynamic faceguard connector 16 comprises a bracket 100 with a movable segment and a stable segment that are operatively connected to each other to facilitate movement of the faceguard 35 when an impact force is applied thereto. In the embodiment shown in the Figures, the bracket's movable segment is the peripheral bracket segment 113 and the stable segment is the internal segment 114. The bracket 100 also includes a band or strap member 102 that wraps around a peripheral bar member 52*c* that extends downwardly and transversely from the upper bar member 52*a*. The lower faceguard connector 15 (discussed in greater detail in pending U.S. patent application Ser. No. 12/082,920) also comprises a bracket 15*a* with a band that encircles the periphery of a peripheral member bar 52*d* that extends upwardly and transversely from a lower bar member 52*e*. The band 102 of bracket 100 forms a receiver 104 that encircles the bar 52*c*, wherein the receiver 104 provides a single encircling point for the faceguard bar 52*c*. The receiver 104 is oriented substantially perpendicular to the longitudinal axis of the bracket 100. The bracket 100 additionally includes a rear flange 106, that includes the band 102 and the receiver 104, and a frontal tab 108. A first side rail 110 and a second side rail 112 extend between the flange 106 and the frontal tab 108. The flange 106, the frontal tab 108, and the side rails 110, 112 collectively comprise the peripheral segment 113 of the bracket 100. The bracket 100 has a "clam-shell" design such that it opens about the receiver 104 and flange 106 to receive the faceguard bar 52*c*. Due to the clam-shell configuration, the bracket 100 has an outer half or portion 122 and an inner portion 124, as described in more detail below, that meet at a rear seam extending along the receiver 104. Thus, the peripheral segment 113 of the outer portion 122 includes an outer side rail segment 110*a* of the first side rail 110, an outer side rail segment 112*a* of the second side rail 112, and an outer segment 108*a* of the frontal tab 108. Similarly, the peripheral segment 113 of the inner portion 124 includes an inner side rail segment 110*b* of the first side rail 110, an inner side rail segment 112*b* of the second side rail 112, and an inner segment 108*b* of the frontal tab 108. Consequently, the first side rail 110 comprises the outer side rail segment 110*a* and the inner side rail segment 110*b*; the second side rail 112 comprises the outer side rail segment 112*a* and the inner side rail segment 112*b*; and the frontal tab 108 comprises the outer segment 108*a* and the inner segment 108*b*.

The connector bracket 100 includes a hinged internal segment 114 that enables the bracket 100 to flex when impact forces are applied to the faceguard 35. As explained below, the peripheral segment 113 flexes or moves relative to the internal segment 114 when an impact force F is applied to the face guard 35. Because the bracket 100 has a clam-shell configuration, the hinged segment 114 has an outer portion 114*a* associated with the outer portion 122, and an inner portion 114*b* associated with the inner portion 124. The hinged internal segment 114 connects to the frontal tab 108, and includes a frontal recess 115 at the interface with the frontal tab 108. The frontal recess 115 defines a hinge line 115*a* for the internal segment 114, wherein both are substantially perpendicular to the longitudinal axis of the bracket 100. A rear extent of the hinged internal segment 114 that is opposite the frontal recess 115 is free or not connected to the first side rail 110 and the second side rail 112. Also, the hinged internal segment 114 does not connect to the flange 106 and therefore, the hinged internal segment 114 and the flange 106 move independently of each other. A gap 116 is formed between the hinged internal segment 114, the first side rail 110, the second side rail 112, and the peripheral flange 106, namely the internal walls of same. The gap 116 includes opposed recesses 118*a*, 118*b* disposed adjacent the frontal tab 108. The opposed recesses 118*a*, 118*b* separate the hinged internal segment 114 from the first side rail 110 and the second side rail 112, allowing motion of the side rails 110, 112 relative to the hinged internal segment 114. The gap 116 has curvilinear segments as shown in FIG. 3*a*. The curvilinear segments of the gap 116 are complimentary to a profile of a periphery of the hinged internal segment 114. The hinged internal segment 114 further comprises an opening or bore 120. The opening 120 is adapted to receive an elongated fastener, such as coupler 50, to secure the bracket 100 and the faceguard 35 to the shell 11. The hinged internal segment 114 additionally has a countersink 121, aligned with the opening 120, to enable a head portion of the fastener to reside below the outer portion 122.

As shown in FIGS. 3*b*, 3*c*, 9, 9*a*, and 10, the outer bracket portion 122, including the outer first side rail segment 110*a*, the outer second side rail segment 112*a*, and the frontal tab outer segment 108*a*, defines an inclined outer wall surface 126 of the outer portion 122 that extends between the front tab 108 and the rear flange 106. The inner bracket portion 124, including the inner first side rail segment 110*b*, the second outer side rail segment 112*b*, and the frontal tab inner segment 108*b*, defines a generally planar inner wall surface 128. Referring to FIG. 3*c*, the internal portion 114*b* of the inner portion 114 has an inner surface 114*d* that is slightly recessed from the inner wall surface 128. Preferably, an outer surface 114*c* of the outer segment 114*a* of the internal segment 114 is recessed from the outer wall 126 of the outer portion 122 thereby forming an offset K. Further, an internal cavity 117 is formed between the internal segment 114 the internal portions of the side rails 110, 112 and the flange 106. Preferably, the offset K varies over the length of the bracket 100, in that the offset K is smaller near the frontal tab 108 and the offset K is larger near the peripheral flange 106. The offset K facilitates pivotal movement of the peripheral segment 113 relative to the internal segment 114 upon an impact to the faceguard 35. In addition, one of the outer portion 122 and the inner portion 124 has a protrusion 130 that interacts with a recess 132 formed in the other of the outer portion 122 and the inner portion 124, preferably at a location adjacent the hinge line of the internal segment 114. In the embodiment discussed above, the bracket's movable segment is the peripheral segment 113 and the stable segment is the internal segment that are operatively connected. Alternatively, the peripheral segment 113 is fixed and internal segment 114 is movable when an impact force is applied to the faceguard 35, as discussed below. In another alternate configuration, the bracket 100 includes a front segment and a rear segment, wherein one of the segments moves when an impact force is applied to the faceguard 35 and the other of the segments remains stable and secured to the shell 11.

Figure 6:
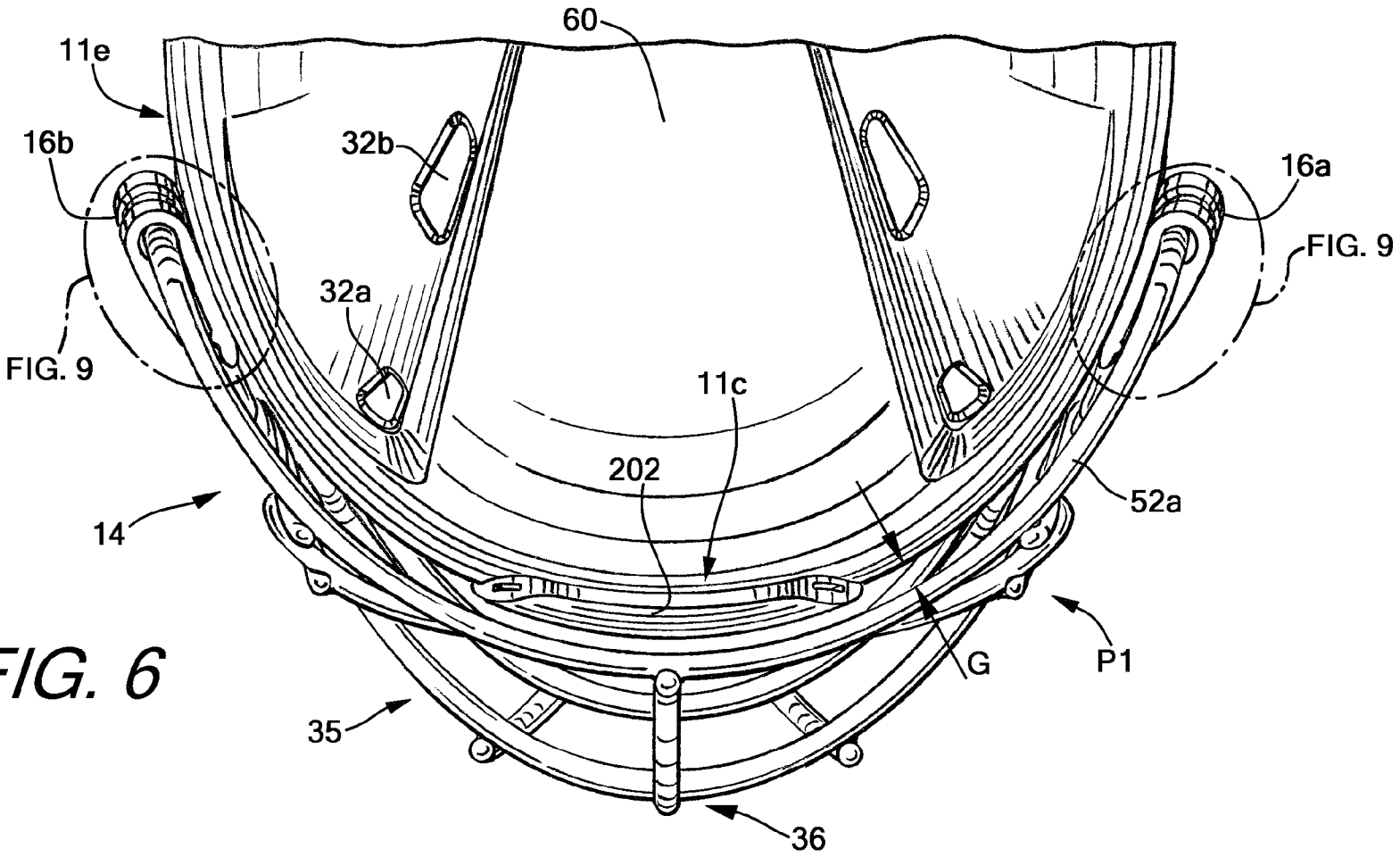
FIG. 6 is a partial top view of the helmet of FIG. 1 showing the energy attenuating system of the helmet in an installed position, $P_1$.

FIGS. 6 and 9 show the energy attenuating faceguard mounting system 14 in an installed or first position P1 (and prior to any impact to the helmet 10), wherein the faceguard 35 is dynamically connected to the helmet 10 by the connectors 16. The first position P1 reflects the connector 16 position before an impact is applied to the faceguard 35, or the post impact state where energy from an impact has been fully absorbed and dissipated by the energy attenuating faceguard mounting system 14. In the first position Pl, upper bar members 52*a*, b extend between the connectors 16 but do not connect with the helmet 10 at or near the shell's brow region 11*c*or front bumper 202, thereby providing the gap G. Referring to FIG. 9, the inner wall 128 of the inner portion 124 is spaced a distance D1 from the outer surface 18 of the shell 11 at the interface area 11*e*. The distance D1 also represents the distance between the outer shell surface 18 and the inner first and second side rail segments 110*b*, 112*b*. In general terms, when an impact to the faceguard 35 occurs, the internal segment 114 remains substantially stable, but the flange 106 and the side rails 110, 112 of the peripheral segment 113 flex relative to the internal segment 114. Depending upon the magnitude and duration of an impact to the faceguard 35, this movement occurs in two directions--outward from the shell 11, and inward towards the shell 11-which provides the connector 16 with dynamic characteristics upon an impact to the faceguard 35. The faceguard 35 is shown in the Figures as single structure formed from a plurality of intersecting bar members. Alternatively, the faceguard 35 comprises distinct portions, such as an upper portion and a lower portion wherein each portion includes a plurality of intersecting bar members. This faceguard 35 configuration can result from the removal of the lower vertical bar members 39 (see FIG. 1) that extend from the lower portion to the upper portion. Assuming the resulting upper portion of the faceguard is secured to the helmet shell 11 by the dynamic connectors 16, the upper faceguard portion will behave in a manner consistent with that described below for both on-center and off-center impacts.

Figure 7:
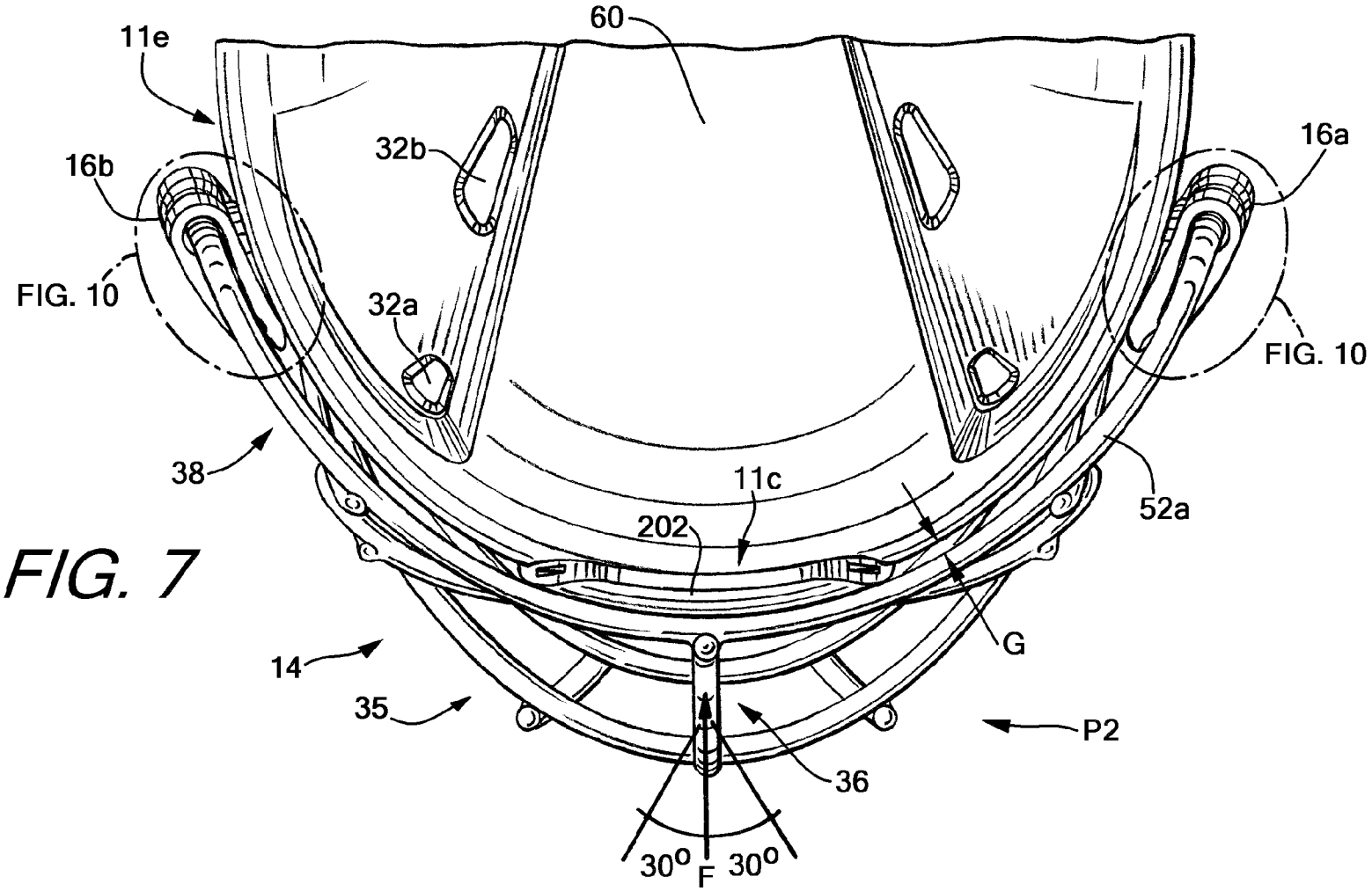
FIG. 7 is a partial top view of the helmet of FIG. 1 showing the energy attenuating system of the helmet wherein a generally on-center force F is applied to the faceguard.

FIGS. 7 and 10 show the energy attenuating faceguard mounting system 14 in a second position P2 wherein an "on-center" impact force F, that is substantially lateral, is applied to a center point 36 of the faceguard 35. The on-center impact F occurs within thirty degrees)(30° of the faceguard center point 36, which may be defined by a substantially vertical center bar member 37. Alternatively, the center bar member 37 is omitted and the center point 36 is located between two other vertical bar members, for example vertical bars in the upper or lower portion of the faceguard 35. When the on-center impact F occurs, the faceguard 35 is displaced towards the shell 11 whereby the bracket 100 flexes outward relative to (or away from) the outer shell surface 18 at the interface area 11*e*. Specifically, the peripheral flange 106, the first side rail 110 and the second side rail 112 move away from the outer shell surface 18 at the interface area 11 e, while the internal segment 114 remains stable due to the securement with the helmet shell 11 provided by the coupler 50. Thus, the peripheral flange 106, the first side rail 110 and the second side rail 112 move relative to the internal segment 114 along the hinge line 115*a*. Referring to FIG. 10, a distance D2 (where D2 exceeds D1) exists between the outer shell surface 18 and the inner wall 128 of the inner portion 124. The distance D2 also represents the distance between the outer shell surface 18 and the inner first and second side rail segments 110*b*, 112*b*). By referencing FIG. 10 for both connectors 16, FIG. 7 indicates that both faceguard connectors 16 will behave similarly and experience the same amount of flex during an on-center impact. However, it is understood that an impact force F that is not purely on-center but that falls within 30 degrees of on-center (or within the total 60 degree window) may cause one connector 16 to behave slightly differently than a second connector 16. For example and referring to FIG. 7, an impact force that is applied 10 degrees off-center on a center left portion of the face guard 35 will cause the helmet's left connector 16*a* to flex less than the helmet's right connector 16*b*. Therefore, the distance D2 between the left connector 16*a* and the outer shell surface 18 at the interface area 11*e* is less than the distance D2 between the right connector 16*b* and the outer shell surface 18 at the interface area 11*e*.

The movement of the faceguard 35 provided by the dynamic connectors 16 dissipates energy received by the faceguard 35 from the on-center impact, and temporarily reduces the gap G between the faceguard upper bars 52 and the shell 11 (as compared to the gap G in the first position P1 of FIG. 6). Under most impact conditions, the gap G is temporarily reduced but not entirely eliminated, whereby the transmission of faceguard impact forces to the shell front 21 is reduced. Due to the nature of the faceguard impact, the dynamic faceguard connector 16 experiences both inward and outward movement relative to the shell 11 during an on-center impact. The extent of this dual movement varies with a number of impact factors, including the speed of the impact, the duration of the impact and the faceguard location of the impact. Nonetheless, under a moderate or severe on-center impact, the connector bracket 100 rapidly moves (or flexes) outward relative to the shell 11 and then inward relative to the shell 11 several times per impact. In this regard, the connector's flange 106 and side rails 110, 112 oscillate back and forth about the stable internal segment 114 until the impact energy is sufficiently dissipated. To further aid energy attenuation, the bar members 36 of the faceguard 35, including the uppermost bars 52*a*, b elastically deform upon an impact. During a significant on-center impact force F, the faceguard 35 elastically deforms such that the opposed peripheral faceguard regions 38 move outward or away from the helmet shell 11. Thus, the dynamic faceguard connectors 16*a*, b facilitate and/or enable movement of the peripheral faceguard regions 38 that is substantially normal or substantially perpendicular to the outer shell surface 18 at the interface area 11*e* when an on-center impact force F is applied to the faceguard 35.

Figure 8:
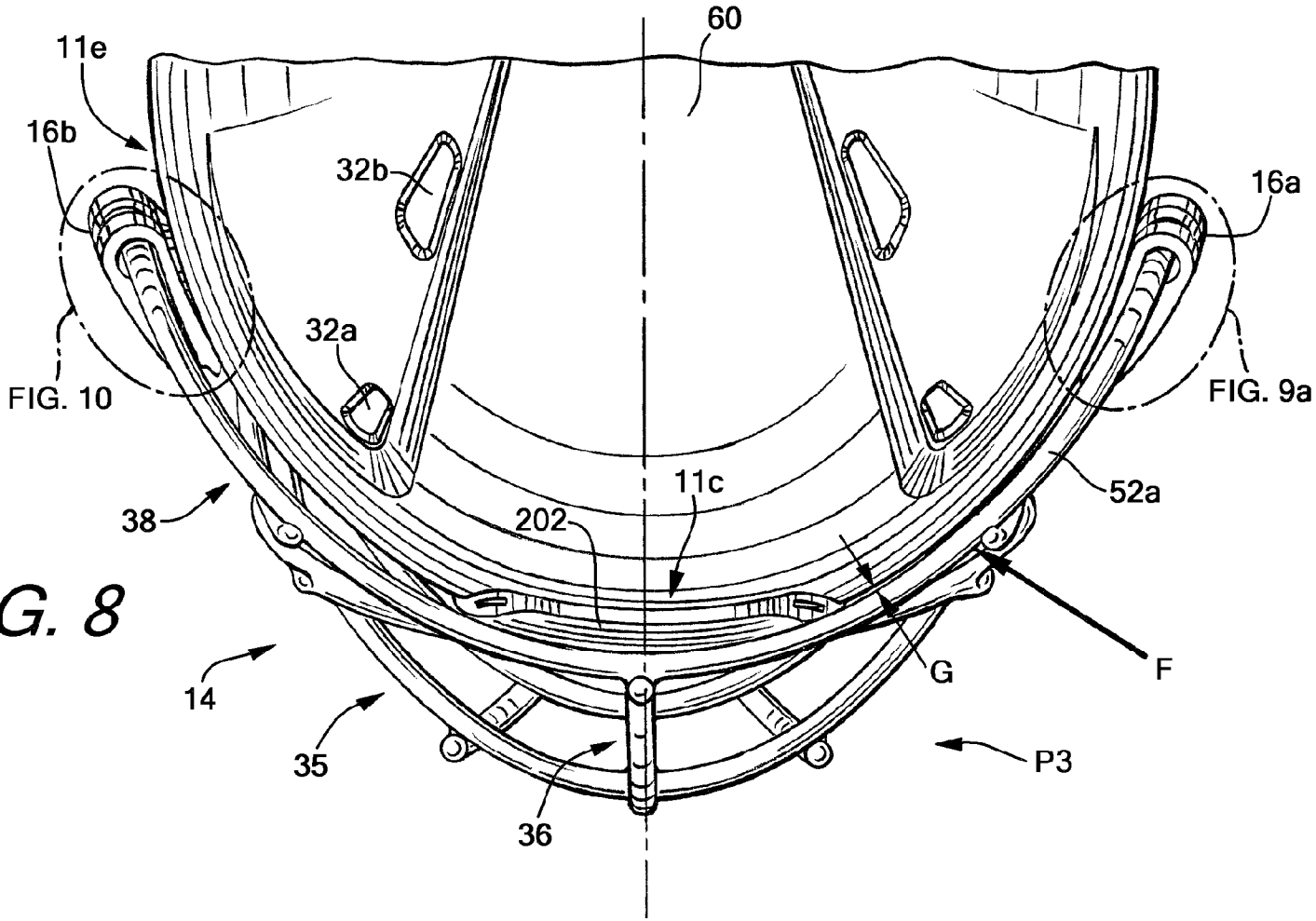
FIG. 8 is a partial top view of the helmet of FIG. 1 showing the energy attenuating system of the helmet wherein a generally off-center force F is applied to the faceguard.

FIGS. 8, 9*a*, and 10 show the energy attenuating faceguard mounting system 14 in a third position P3 wherein an "off-center" impact force F, that is substantially lateral, is applied to the faceguard 35. The off-center impact F occurs to the side of the face guard 35 beyond thirty degrees)(30° of the faceguard center point 36. Referring to FIG. 8, the off-center impact F occurs at a left portion of the faceguard 35, between a lowermost bar 36 and [[an]] the uppermost bar 52*a*. Due to the off-center impact force F, the gap G on the left side of the face guard 35 is temporarily eliminated. The gap G on the right side of the face guard 35 is similar to that for the first position P1 (see FIG. 6), however, under certain impact conditions, this gap G may slightly, temporarily increase. When the off-center impact F occurs, the left faceguard connector 16*a* and the left peripheral faceguard portion 38*a* compresses towards the interface area 11*e* of the helmet shell 11, and the right faceguard connector 16*b* and the right peripheral faceguard portion 38*b* flexes away from the interface area 11*e* of the helmet shell 11. Thus, the faceguard connector 16 and the peripheral faceguard portion 38 located on an opposite side of the faceguard as the off-center impact force F initially moves outward and substantially normal relative to the interface area 11*e* of the shell 11, while the faceguard connector 16 and the peripheral faceguard portion 38 on the same side as the impact force F initially moves inward and substantially normal relative to the interface area 11*e* of the shell 11. Upon an off-center impact, the faceguard connectors 16 behave differently which demonstrates the dynamic nature of the connector 16. When the off-center impact F occurs, the right connector 16*b*, including the bracket 100, behaves in the manner described above and shown in FIG. 10. The bracket 100 of the left connector 16*a* initially moves towards the interface area 11*e* of the helmet shell 11 and depending upon the magnitude and duration of the impact F, the inner bracket wall 128 makes contact with the outer shell surface 18. In this manner, the distance D3 between the outer shell surface 18 and the inner wall 128 of the inner portion 124 is temporarily eliminated. The bracket 100 of the left connector 16*a* then moves away from the shell outer surface 18. When the off-center impact force F has a lesser magnitude and/or duration, the inner portion 124 of the connector 16*a* may not contact the outer shell surface 18 and the distance D3 is less than D2 or Dl. Thus, the faceguard connector 16 on the same side of the faceguard 35 as the off-center impact F initially moves towards the helmet shell 11, and the connector 16 on the other side of the faceguard 35 initially moves away from the helmet shell 11.

While substantially lateral or horizontal impact forces F are discussed above, it has also been observed that an on-center impact force F applied in a vertically downward direction to the faceguard 35 cause the dynamic faceguard connectors 16 to flex outward relative to the shell 11. This behavior is similar to when a lateral impact force F is applied on-center to the faceguard 35. Conversely, an on-center impact force F applied in a vertically upward direction (towards the crown 19) to the faceguard 35 cause the dynamic faceguard connectors 16 to flex inward relative to the shell 11. Testing the inventive helmet 10 involved mounting it on a Hybrid III headform that is coupled to a test table that is movable along a single axis. A ram is moved axially along the single axis in the same direction that the moveable table may travel. The ram was moved at different speeds, such as, for example, 5 m/s, 7 m/s, and/or 9 m/s, to deliver a force to the faceguard 35 of the helmet 10. Sensors within the headform measure lateral acceleration as well as severity index of the impact of the ram with the helmet 10. This testing has shown that the helmet 10 and its energy attenuating facemask mounting system 14 significantly reduces both lateral acceleration and severity index of impacts delivered by the ram to the faceguard 35 over a variety of impact speeds.

Figure 4:
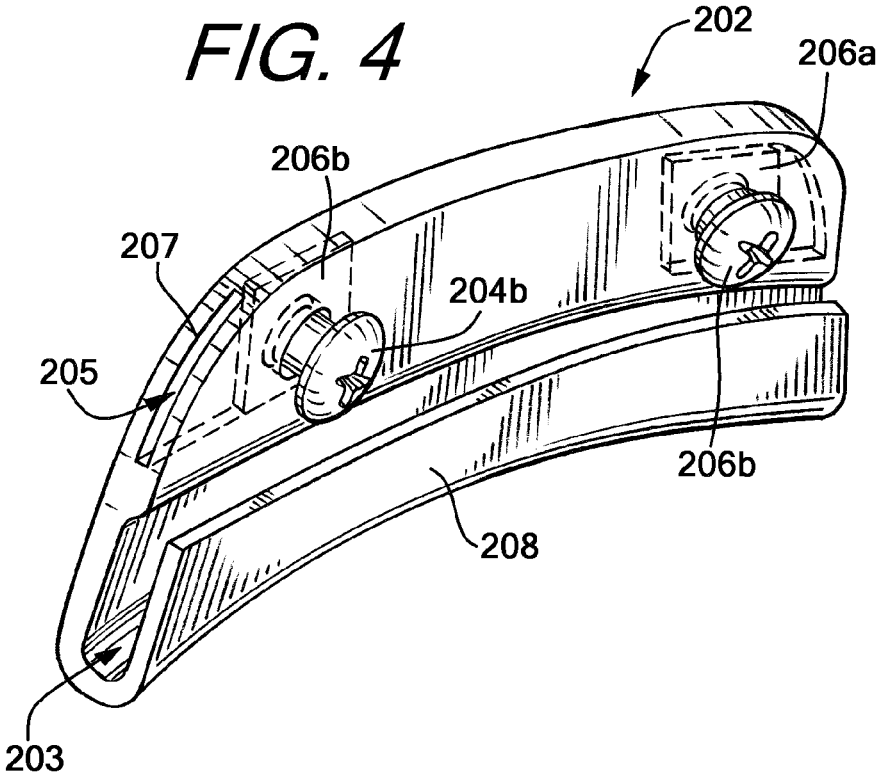
FIG. 4 is a perspective view of a nameplate used with the helmet of FIG. 1.
Figure 5:
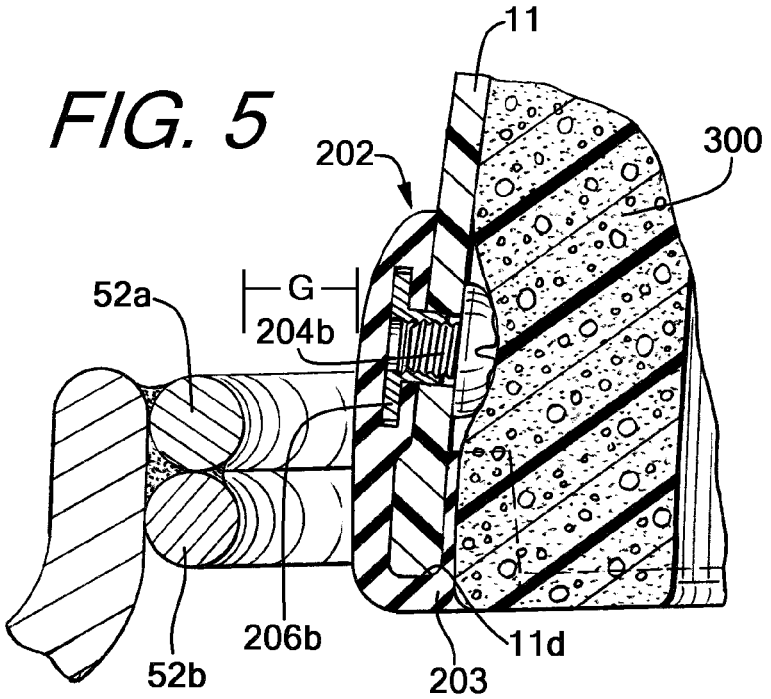
FIG. 5 is a cross-sectional view of the nameplate of FIG. 4, showing the nameplate mounted to the helmet and a gap G between the faceguard member and the helmet.

FIGS. 4 and 5 show a front bumper or nameplate 202 affixed to the brow region 11*c* of the shell 11 by internal fasteners that are not externally visible. The bumper 202 has a curvilinear configuration that substantially corresponds to the configuration of the brow region 11*c*, and facilitates the positioning and securement of the internal padding assembly 300. Fastener 204*a*, 204*b* passes through an opening in the shell 11 and is received by respective nuts 206*a*, 206*b* that are secured within an internal pocket 205 formed in the bumper 202. Preferably, the pockets 205 are in an opposed relationship, wherein each pocket 205 has an access slot 207 aligned with the periphery of the bumper 202. The internal pocket 205 retains the nuts 206*a*, 206*b* as the helmet 10 lacks any connectors for the upper bar 52 of the faceguard 35 at the brow region 11*c* of the shell 11. The bumper 202 also includes a lower groove 203 that is defined by an internal flange 208 and that engages the frontal opening upper edge 11*d* of the shell 11 to facilitate engagement thereto. The bumper 202 contains an outer surface that allows for indicia, such as the manufacturer of the helmet 10, or the name of a team of the wearer 500. Because the nuts 206*a, b* are internally retained and there is no faceguard connection point at the brow region 11*c*, the helmet 10 lacks any externally visible fastener hardware at the brow region 11*c*. In contrast, conventional helmets utilize external fastening hardware to secure the faceguard to the bumper and helmet, which reduces the aesthetic appearance of the conventional helmet.

Figure 13:
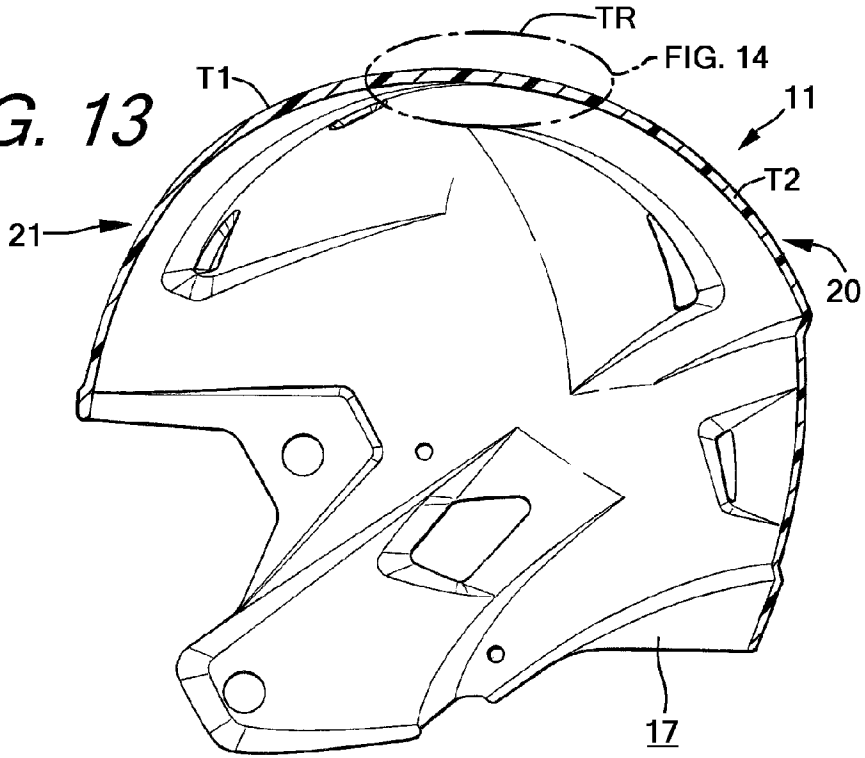
FIG. 13 is a cross-sectional view of the shell portion of the helmet taken through line 13-13 of FIG. 12.
Figure 14:
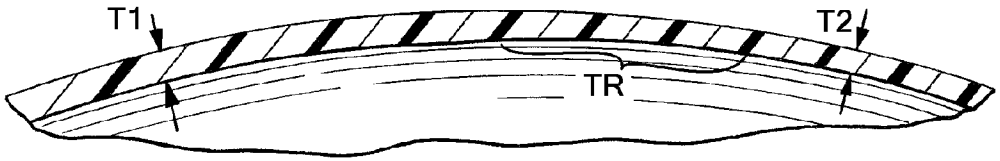
FIG. 14 is a partial cross-sectional view of the shell portion of the helmet shown within dotted lines 14 of FIG. 13.

FIGS. 11-16 show the shell 11 having a transition region TR, where the thickness of the shell 11 varies from a first thickness at the front portion 21 of the shell 11 to the rear portion 20 of the shell 11. In the embodiment shown, the transition region TR is a transverse band that extends between the symmetric left and right side regions 24*a,b* of the shell 11, preferably rearward of the ear openings 12. Preferably, the transition region extends from the lower shell edge 22 of the left shell portion 22*a* to the lower shell edge 22 of the right shell portion 22*b*. The transition region TR intersects and includes the raised central band 60 that extends from the front shell portion 21 and along the crown 19. The transition region TR is roughly 1 inch wide and the thickness of the shell 11 transitions from about 0.125 inches in the front shell portion 21 to about 0.100 inches in the rear shell portion 20. This reduction in width reduces the weight of the helmet 10, and the amount of raw material used to form the shell 11. FIG. 12 provides a frontal view of the helmet 10, with a central axis A-A dividing the shell 11 into the left region 24*a* and right region 24*b*. The shell 11 includes an internal rib extending along the inner shell surface 17 from the rear shell portion 20 upward through the crown 19 and towards the front shell portion 21. Section plane 13-13, corresponding to the cross-section of FIG. 13, is taken slightly right of the central axis A-A (as viewed in the FIG.) and beyond the internal rib on the left shell portion 22*a*. Referring to FIGS. 14, the shell 11 has a frontal shell segment with a first thickness T1 forward of the transition region TR and a rear shell segment with a second thickness T2 rearward of the transition region TR, wherein the first thickness T1 exceeds the second thickness T2.

Figure 15:
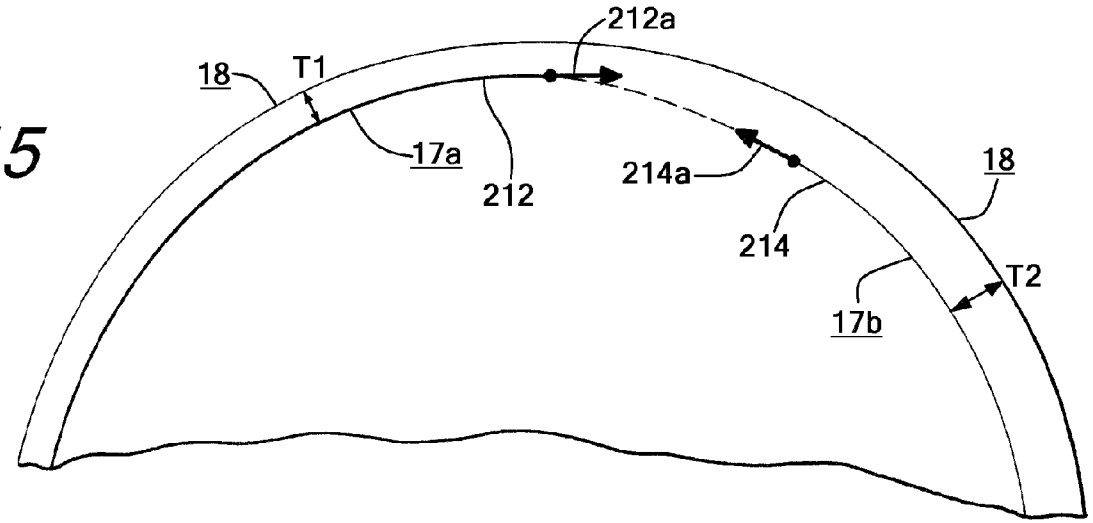
FIG. 15 is a partial sectional view of a transitional region of the shell portion of the helmet showing the curvature of a front portion of the shell and a rear portion of the shell.
Figure 16:
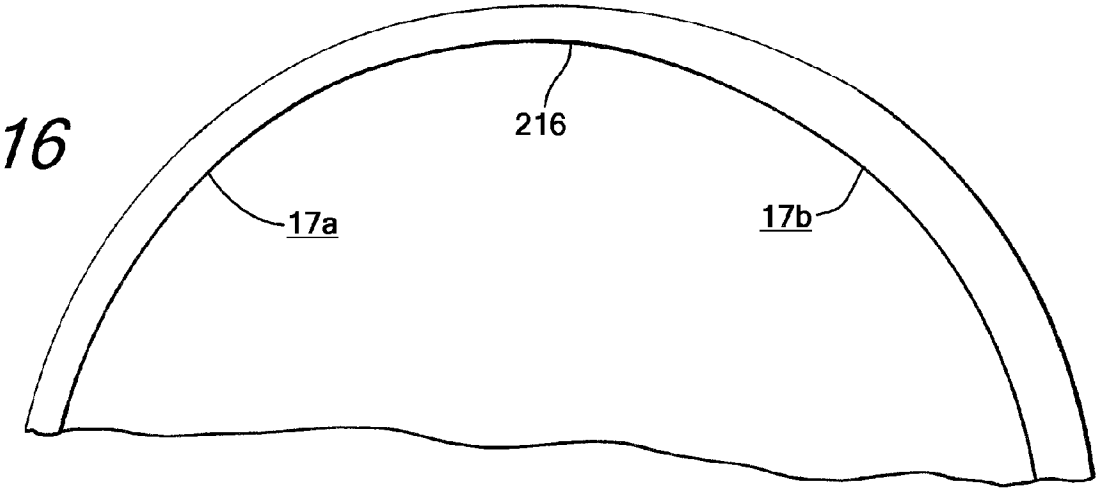
FIG. 16 is a partial sectional view of a transitional region of the shell portion of the helmet showing the curvature of the front portion of the shell, the rear portion of the shell, and a transitional portion of the shell; and, FIG. 17 is a rear view of the helmet of FIG. 1.

Referring to the schematic views of FIGS. 15 and 16, the transition region TR extends between the two thicknesses T1, T2. The first thickness T1 is defined between an inner frontal shell surface 17*a* and the outer shell surface 18, while the second thickness T2 is defined between an inner rear shell surface 17*b* and the outer shell surface 18. The inner frontal shell surface 17*a* has a first radius of curvature 212 and a tangential arrow 212*a* thereof, as well as a second radius of curvature 214 and a tangential arrow 214*a* thereof. To provide a substantially smooth configuration to the inner shell surface 17 that avoids abrupt or sharp changes to the shell geometry, it is preferable that the transition region TR has a radius of curvature 216 (see FIG. 16) that is tangential to both the frontal shell surface 17*a* and the rear shell surface 17*b* proximate the arrows 212*a*, 214*a*, respectively While the specific embodiments have been illustrated and described, numerous modifications come to mind without significantly departing from the spirit of the invention, and the scope of protection is only limited by the scope of the accompanying Claims.

We claim:

1. A protective sports helmet comprising:

a shell configured to receive a head of a wearer of the helmet, the shell having a front region, a rear region, and two side regions wherein each side region has an ear flap;

a faceguard comprising a plurality of bar members; and a dynamic faceguard connector that secures a peripheral bar member of the faceguard to the ear flap of the shell, the dynamic connector including a bracket with a movable segment and a stable segment;

wherein when an impact force is applied to the faceguard, the movable segment of the bracket moves away from an outer surface of the ear flap to facilitate movement of the faceguard;

wherein the movable bracket segment includes a flange that receives an extent of the peripheral bar member, a frontal tab opposite the flange, and a pair of side rails extending between the flange and the frontal tab, wherein the flange, frontal tab and side rails collectively define a periphery of the bracket;

wherein the stable bracket segment is an internal portion operably connected to the frontal tab of the movable bracket segment by a flexible hinge, wherein the stable bracket segment includes an opening that receives a coupler to secure the dynamic faceguard connector and the faceguard to the shell.

2. The sports helmet of claim 1, wherein a continuous gap is formed between an upper horizontal bar member of the faceguard and the front region of the shell prior to an impact force being applied to the faceguard, wherein the continuous gap extends along the length of the upper horizontal bar member and the front shell region.

3. The sports helmet of claim 2, wherein the helmet includes a second dynamic faceguard connector, wherein said dynamic faceguard connectors are arranged in an opposed positional relationship on said ear flaps, and wherein the upper horizontal bar member extends between the opposed dynamic connectors without contacting the front region of the shell prior to an impact force being applied to the faceguard.

4. The sports helmet of claim 1, wherein the movable bracket segment flange includes a receiver that receives an extent of the peripheral bar member, the bracket having a clamshell configuration.

5. The sports helmet of claim 1, wherein the movable bracket segment is a peripheral segment of the bracket that is operably connected by the flexible hinge to the stable bracket segment that is an internal segment of the bracket, wherein the coupler secures the stable segment in a substantially stable position against the shell while the movable segment moves away from an outer surface of the ear flap of the shell when the impact force is applied to the faceguard.

6. The sports helmet of claim 1, wherein the ear flap includes a lower recessed channel extending upward and rearward from a lower edge of the shell, and wherein the lower recessed channel is configured to receive an extent of a chin strap member.

7. The sports helmet of claim 1, wherein in an installed position prior to an impact force being applied to the faceguard, the movable bracket segment is positioned at a first distance defined between an inner wall of the movable bracket segment and the shell;

wherein upon an impact force being applied to the faceguard, the movable bracket segment being displaced a second distance defined between said inner wall and said shell; and, wherein the first distance is less than the second distance.

8. A protective sports helmet comprising:

a she configured to receive a head of a wearer of the helmet, a faceguard including opposed peripheral bar members; and a pair of dynamic faceguard connectors for securing the faceguard to the shell, a first dynamic connector securing a first peripheral bar member to a first interface area of the she and a second dynamic connector securing a second peripheral bar member to a second interface area of the shell, the first and second dynamic connectors each including a bracket with a peripheral segment and an internal segment residing within the peripheral segment;

wherein the internal segment of the bracket remains stable while the peripheral segment of the bracket moves substantially perpendicular to the interface area of the shed when an impact force is applied to the faceguard;

wherein each peripheral bracket segment includes a flange that receives an extent of the peripheral bar member, a frontal tab opposite the flange, and a pair of side rails extending between the flange and the frontal tab, wherein the flange, frontal tab and side rails collectively define a periphery of the bracket;

wherein each internal bracket segment is operably connected to the frontal tab of the peripheral bracket segment by a flexible hinge.

9. The sports helmet of claim 8, wherein an uppermost horizontal bar member of the faceguard extends between the opposed dynamic connectors without contacting a front region of the shell prior to an impact force being applied to the faceguard.

10. The sports helmet of claim 8, wherein the flange of the peripheral segment includes a receiver that receives an extent of the peripheral bar member, wherein the peripheral bar member extends transversely downward from an uppermost bar member of the faceguard.

11. The sports helmet of claim 8, wherein the internal bracket segment includes an opening that receives a quick-release coupler to secure the dynamic connector and the faceguard to the shell.

12. The sports helmet of claim 8, wherein the shell includes opposed side regions, wherein each side region has an ear flap with a lower recessed channel extending upward and rearward from a lower edge of the shell, and wherein the lower recessed channel is configured to receive an extent of a chin strap member.

13. The sports helmet of claim 8, wherein in an installed position prior to an impact force being applied to the faceguard, the peripheral segment of each bracket is positioned at a first distance defined between an inner wall of the peripheral segment and the interface area of the shell;

wherein upon an on-center impact force being applied to the faceguard, the peripheral segment of each bracket being displaced substantially perpendicular to the interface area, a second distance defined between said inner wall and said interface area; and, wherein the first distance is less than the second distance.

14. The sports helmet of claim 8, wherein the first and second dynamic faceguard connectors move substantially perpendicular to the interface areas of the shell after an on-center impact is applied to the faceguard.

15. The sports helmet of claim 14, wherein when an off-center impact force is applied off-center to the faceguard, the first connector bracket moves differently than the second connector bracket, wherein the peripheral segment of the first connector bracket moves towards the first interface area of the she and the peripheral segment of the second connector bracket moves substantially perpendicular to the second interface area of the shell.

16. A protective sports helmet comprising:

a she configured to receive a head of a wearer of the helmet;

a faceguard including opposed peripheral bar members; and a pair of dynamic faceguard connectors for securing the faceguard to the shell, a first dynamic connector securing a first peripheral bar member to a first interface area of the shell and a second dynamic connector securing a second peripheral bar member to a second interface area of the shell, the first and second dynamic connectors each including a bracket with a peripheral segment and an internal segment residing within the peripheral segment;

wherein each peripheral bracket segment includes a flange that receives an extent of the peripheral bar member, a frontal tab opposite the flange, and a pair of side raps extending between the flange and the frontal tab, wherein the flange, frontal tab and side rails collectively define a periphery of the bracket;

wherein each dynamic connector includes a flexible hinge that operably connects the peripheral bracket segment and the internal bracket segment;

wherein when an on-center impact force is applied to the faceguard, the internal segment of the first and second connector brackets remains stable while the peripheral segment of the first and second connector brackets moves substantially perpendicular to the respective first and second interface areas of the shell; and, wherein when an off-center impact force is applied off-center to the faceguard, the first connector bracket moves differently than the second connecter bracket, wherein the peripheral segment of the first connector bracket moves towards the first interface area of the shell and the peripheral segment of the second connector bracket moves substantially perpendicular to the second interface area of the shell.

17. The sports helmet of claim 16, wherein an uppermost horizontal bar member of the faceguard extends between the opposed dynamic connectors without contacting a front region of the shell prior to an impact force being applied to the faceguard.

18. The sports helmet of claim 16, wherein the peripheral bar member extends transversely downward from an uppermost bar member of the faceguard.

19. The sports helmet of claim 16, wherein the shell includes opposed side regions wherein each side region has an ear flap with a lower recessed channel extending upward and rearward from a lower edge of the shell, and wherein the lower recessed channel is configured to receive an extent of a chin strap member.

20. The sports helmet of claim 16, wherein in an installed position prior to an impact force being applied to the faceguard, the peripheral segment of each bracket is positioned at a first distance defined between an inner wall of the peripheral segment and the interface area of the shell;

wherein upon an on-center impact force being applied to the faceguard, the peripheral segment of each bracket being displaced substantially perpendicular to the interface area, a second distance defined between said inner wall and said interface area; and, wherein the first distance is less than the second distance.

* * * * *

UNITED STATES PATENT AND TRADEMARK OFFICE

CERTIFICATE OF CORRECTION

PATENT NO. : 9,289,024 B2
APPLICATION NO. : 13/068104
DATED : March 22, 2016
INVENTOR(S) : Chris Withnall et al.

It is certified that error appears in the above-identified patent and that said Letters Patent is hereby corrected as shown below:

Claims

At column 16, claim number 8, line 20, it currently reads... a she configured to receive a head of a wearer of the helmet, ... but should read -- a shell configured to receive a head of a wearer of the helmet, --

At column 16, claim number 8, line 26, it currently reads... of the she and a second dynamic connector securing a ... but should read -- of the shell and a second dynamic connector securing a --

At column 16, claim number 8, line 34, it currently reads... stantially perpendicular to the interface area of the shed ... but should read -- stantially perpendicular to the interface area of the shell --

At column 17, claim number 15, line 17, it currently reads... she and the peripheral segment of the second connector ... but should read -- shell and the peripheral segment of the second connector --

At column 17, claim number 16, line 21, it currently reads... a she configured to receive a head of a wearer of the helmet; ... but should read -- a shell configured to receive a head of a wearer of the helmet; --

At column 17, claim number 16, line 35, it currently reads... frontal tab opposite the flange, and a pair of side raps ... but should read -- frontal tab opposite the flange, and a pair of side rails --

Signed and Sealed this
Fourteenth Day of June, 2016

Michelle K. Lee

Michelle K. Lee
*Director of the United States Patent and Trademark Office*